US012188214B2

(12) United States Patent
Grace

(10) Patent No.: US 12,188,214 B2
(45) Date of Patent: Jan. 7, 2025

(54) SINK COVER

(71) Applicant: Charlotte Grace, Milwaukee, WI (US)

(72) Inventor: Charlotte Grace, Milwaukee, WI (US)

( * ) Notice: Subject to any disclaimer, the term of this patent is extended or adjusted under 35 U.S.C. 154(b) by 2 days.

(21) Appl. No.: 17/827,767

(22) Filed: May 29, 2022

(65) Prior Publication Data

US 2022/0381015 A1 Dec. 1, 2022

Related U.S. Application Data

(60) Provisional application No. 63/194,891, filed on May 28, 2021.

(51) Int. Cl.
*E03C 1/186* (2019.01)

(52) U.S. Cl.
CPC ..... *E03C 1/186* (2013.01)

(58) Field of Classification Search
CPC ..... A47L 19/02; A47L 19/04; A47L 17/02; A47J 47/20; E03C 1/186
See application file for complete search history.

(56) References Cited

U.S. PATENT DOCUMENTS

| | | | | |
|---|---|---|---|---|
| 958,857 | A * | 5/1910 | Dennis | A47J 47/20 99/449 |
| D292,674 | S | 11/1987 | Morris et al. | |
| D403,586 | S | 1/1999 | Bakic | |
| D424,940 | S | 5/2000 | Degnen | |
| D443,040 | S | 5/2001 | Fabian et al. | |
| 6,959,461 | B1 * | 11/2005 | Sanchez | E03C 1/186 4/654 |
| 7,568,239 | B2 * | 8/2009 | Spruner von Mertz | A47J 47/20 4/654 |
| D748,594 | S | 2/2016 | Takagi et al. | |
| D754,319 | S | 4/2016 | Park et al. | |
| 2006/0064814 | A1 * | 3/2006 | Bushman | A47K 3/002 4/583 |
| 2022/0381015 | A1 | 12/2022 | Grace | |

FOREIGN PATENT DOCUMENTS

| | | | | |
|---|---|---|---|---|
| DE | 102016117406 | A1 * | 3/2018 | A47J 47/005 |
| EP | 0792611 | A1 * | 9/1997 | |
| EP | 1275786 | A2 * | 1/2003 | A47J 47/005 |
| JP | 3193014 | U * | 9/2014 | A47J 47/20 |

* cited by examiner

*Primary Examiner* — Erin Deery
(74) *Attorney, Agent, or Firm* — Mahesh Law Group PC; Kumar Maheshwari

(57) ABSTRACT

A sink cover is disclosed herein. The sink cover includes an edge portion that is shaped to come into contact with a circumference of a rim of a sink and a lip portion that is connected to the edge portion where the lip portion is shaped to extend beyond the circumference of the rim of the sink. The sink cover includes a top portion that is connected to the lip portion to envelop an upper end of the sink cover. The sink cover further includes a sliding mechanism that modifies a length of the sink cover.

9 Claims, 26 Drawing Sheets

SINK COVER

This application claims the benefit of U.S. Provisional Patent Application No. 63/194,891, entitled as "SINK COVER", filed May 28, 2021, which is incorporated by reference in its entirety.

FIELD OF THE INVENTION

This disclosure relates to the field of hardware for the home and kitchen.

BACKGROUND

Kitchen sinks are an indispensable part of a modern home. Most cooking and cleaning tasks in a kitchen will make some use of the sink. Sinks are used to clean a variety of objects including, but not limited to cookware and dining ware. Sinks in kitchens are also used as a storage place for food to thaw and marinate. Sinks may be further used to wash hands or obtain water for a variety of purposes. Further, random activities that are deemed too dirty to be performed in the rest of a home are often performed in kitchen sinks.

Dirty objects may be stored in sinks for a period of time before the objects are cleaned. Further, because uncooked food may also be placed in a sink, the sink is often the dirtiest place in a home. Indeed, kitchen sinks routinely contain far more bacteria than toilets. As such, kitchen sinks are a liability from a certain point of view. The circulating air from a dirty sink is liable to be inhaled by occupants of a home and may come into contact with prepared food. Smells from a sink may foul an otherwise sanitary home. There is a need in the art for a way to maintain the utility of kitchen sinks and do away with their inherent liabilities.

SUMMARY

A general aspect of the invention is a sink cover. The sink cover includes an edge portion that is shaped to come into contact with a circumference of a rim of a sink and a lip portion that is connected to the edge portion where the lip portion is shaped to extend beyond the circumference of the rim of the sink. The sink cover includes a top portion that is connected to the lip portion to envelop an upper end of the sink cover. The sink cover further includes a sliding mechanism that modifies a length of the sink cover. The top portion may be a solid material. An upper side of the top portion may be shaped to be a countertop. The sink cover may further include one or more slots in an inside portion of the sink cover where the slots are shaped to hold kitchenware when the sink cover is flipped with the top portion facing downward. The top portion may be shaped to drain water from the inside portion when the sink cover is rotated with the top portion facing downward. The sink cover may further include a pigment that changes color based on a temperature of the sink cover. At least one of the edges, lip portion, and top portion include a heat insulating material. The sink cover may further include one or more hinges. The one or more hinges may allow the sink cover to fold to decrease a length of the sink cover. The sink cover may further include one or more handles where the sliding mechanism allows two portions of the sink cover to slide past one another to modify the length in one dimension along an axis and at least a portion of the one or more handles are positioned perpendicular to the axis.

Another embodiment is a cover. The cover includes a gasket that seals a rim of a sink and a flange that secures the gasket to a top of the sink. The cover includes a top that overlays the rim of the sink where the top is connected to the flange. The gasket may be extendable to fit a circumference of the rim. The cover may further include a spring mechanism that compresses as the gasket is shortened. The cover may further include a button that releases the spring mechanism to change a length of the gasket. The top may be detachable. The top may be a solid material. An upper side of the top may be shaped to be a countertop.

Another general aspect is a sink cover. The sink cover includes a shell that is configured to cover a sink basin where the shell is shaped to rest upon a surface without fasteners. The shell may include a plane that is shaped to make contact with a shoulder portion of the sink basin around an entire circumference of the sink basin. The shell may be further shaped to fit within a perimeter of a countertop that surrounds the sink basin. The shell may be curved to increase a volume of space under the shell and within the sink basin when the shell is positioned to cover the sink basin.

DETAILED DESCRIPTION

The disclosed subject matter is a sink cover that may be placed over a basin of a sink. The sink cover may isolate the contents of a kitchen sink basin from the rest of a kitchen. A potential use of the sink cover may be for restricting movement of pathogens to and from the sink basin. A kitchen sink is known for containing a large number of pathogens such as bacteria or mold. The sink cover may aid in preventing pathogens from moving from the kitchen sink to other areas of a home. Further, the sink cover may restrict pathogens from access to the sink area where they may proliferate.

An additional use of the sink cover is to restrict the flow of air to and from the sink basin. A sink basin may from time to time be filled with various substances that are offensive, such as stagnant water and decaying food. The sink cover prevents offensive odors of a sink from quickly dispersing into a home. Another use of the sink cover is to restrict sight of the offensive contents inside a sink basin. Merely seeing a substance that gives an offensive odor may be upsetting. The sink cover conceals the offensive contents of a sink basin, which prevents the contents from lowering the attractiveness of a room.

Figure 1:
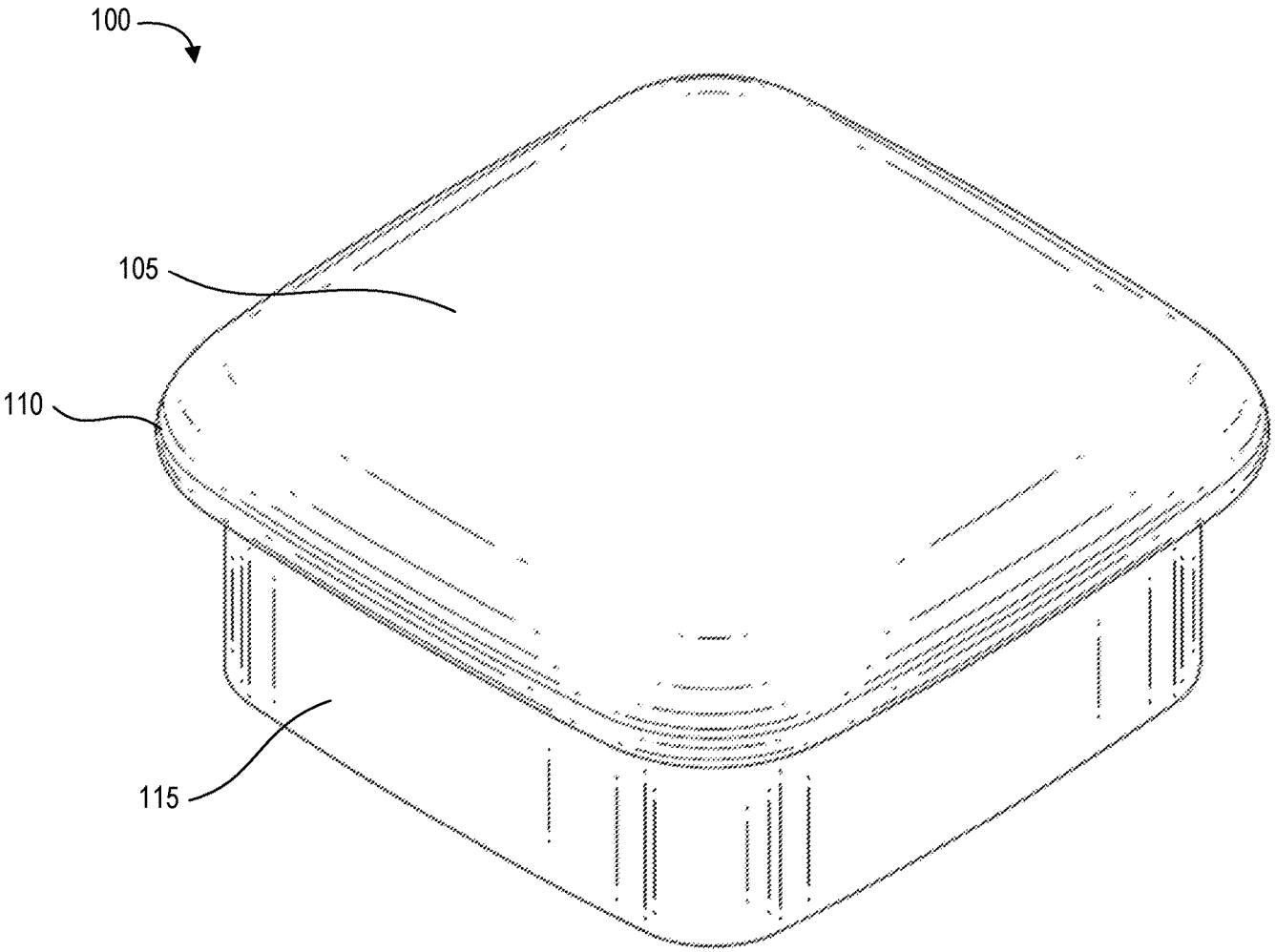
FIG. 1 is an illustration of a top perspective view of an embodiment of the sink cover.

Referring to FIG. 1, FIG. 1 is an illustration of a top perspective view of an embodiment of the sink cover 100. The sink cover 100 is shaped to cover the basin of a sink. Accordingly, the shape of the sink cover 100 may be modified or adjusted based on a shape of the sink basin. Thus, the sink cover 100 may be stretched, elongated, and curved into any shaped of a sink basin including, but not limited to rectangular shapes with sharp, beveled, and chamfered corners, circular shapes, semi-circular shapes, oval shapes, and combinations thereof.

The sink cover 100 comprises a top portion 105 that covers the sink basin. The sink cover further comprises a lip 110 that extends beyond the rim of the sink basin. The lip 110 may also be referred to as a flange. The lip or flange fixes the sink cover 100 to a position when the sink cover is placed over a sink. Attached to the lip 110 is an edge 115 or gasket that forms a seal around the sink basin. The edge 115 and lip 110 may extend around a circumference of a rim of a sink.

The sink cover 100 may cover and/or seal the contents of a sink basin. The sealed contents, if they are offensive to sight, smell, or taste, are prevented from spoiling a room. Further, pathogens, which may be festering within the sink basin, are trapped within the sink cover 100. Likewise, pathogens circulating in the air of a room are locked away from the sink basin where many pathogens such as some types of bacteria and fungi can multiply and proliferate.

Figure 2:
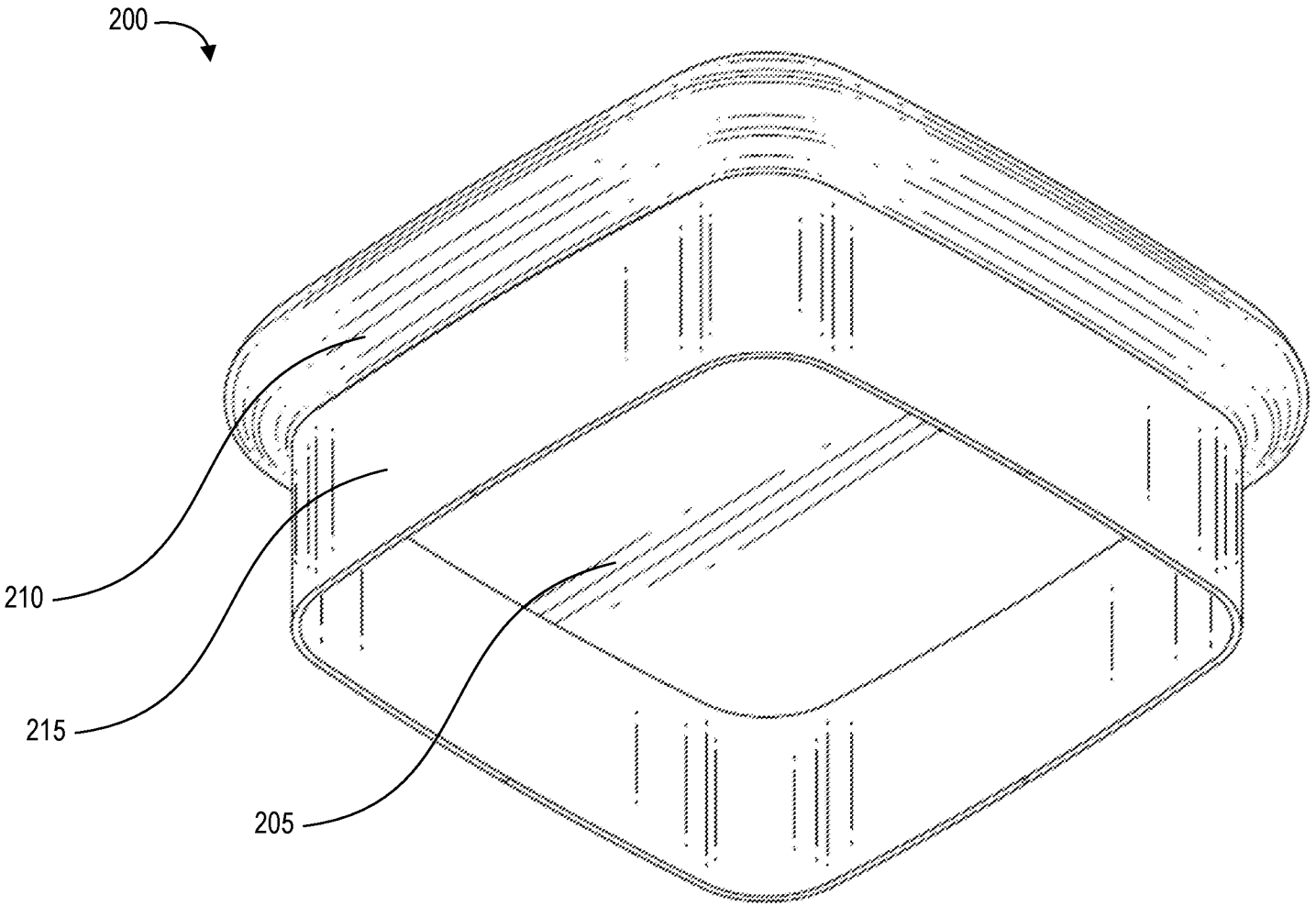
FIG. 2 is an illustration of a bottom perspective view of the sink cover.

Referring to FIG. 2, FIG. 2 is an illustration of a bottom perspective view of the sink cover 200. An underside of the sink cover 200 is visible in the illustration shown in FIG. 2. Contents of a sink basin may be exposed to the underside of the sink cover 200 when the sink cover 200 is placed over a sink basin.

The underside of the sink cover 200 may trap air, heat, and various substances in a sink basin. For example, volatile substances such as vinegar may be placed in a sink basin. The volatile substance may then be covered by the sink cover 200. The sink cover 200 may trap most of the vapors of evaporating vinegar within the covered sink basin. Other substances may be similarly trapped within the sink cover 200. For example, strongly aromatic food that is placed in the sink basin may be covered by the sink cover 200 to prevent smells, both good and bad, from dispersing into a room.

In another example, pathogens may be trapped within a sink basin. Many kitchen sinks contain the highest number of bacteria in a home. The bacteria in a kitchen sink may be better contained while the sink cover 200 is placed over the sink basin. Likewise, mold, spores, or other types of fungi that can proliferate in wet areas such as a sink basin, may be better contained within the sink basin when the sink cover 200 is in place.

The top 205 of the sink cover 200 effectively seals the contents of the sink basin from the area outside the kitchen sink. With the sink cover 200 in place, the kitchen sink may appear to be clean in both sight and smell, which may be of comfort to individuals in a kitchen area. The lip 210 of the sink cover 200 protrudes beyond the rim of the sink basin and prevents the sink cover 200 from entering a sink basin past the point where the rim meets the lip 210. The edge 215 of the sink cover 200 seals the sink cover 200 to the rim of a sink basin. As such, the edge 215 locks the sink cover 200 to the rim to prevent horizontal movement of the sink cover 200. Likewise, the lip prevents downward movement of the sink cover 200 relative to the rim of a sink basin.

Figure 3:
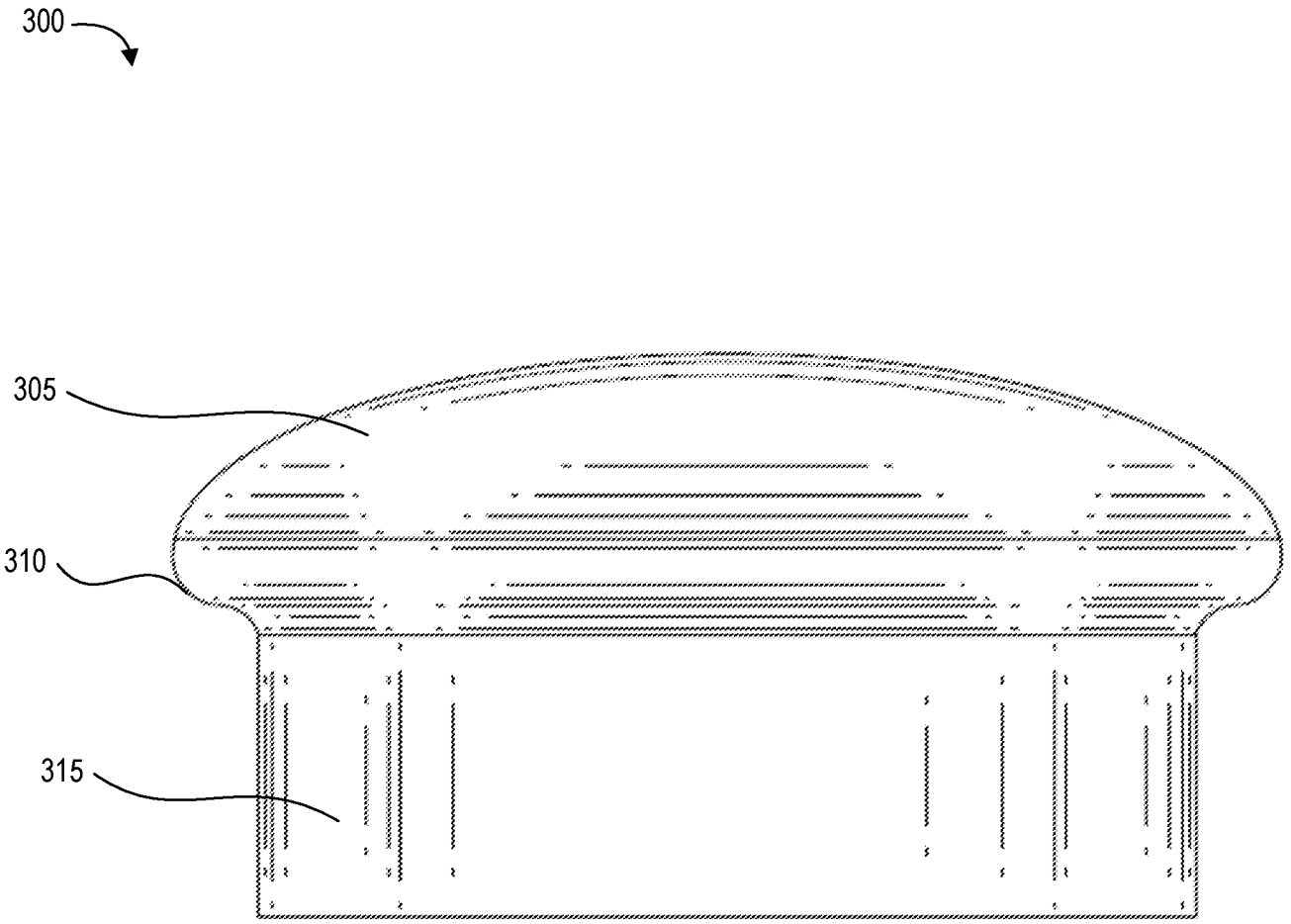
FIG. 3 is an illustration of a side view of the sink cover.

Referring to FIG. 3, FIG. 3 is an illustration of a side view of the sink cover 300. The sink cover 300 shown in FIG. 3 distinctively shows the top 305, the lip 310, and the edge 315 of the sink cover 300. The shape and appearance of the sink cover 300 may vary so long as the sink cover 300 contains these 3 elements.

From the side view shown in FIG. 3, the top 305 of the sink cover 300 has a rounded shape that is convex. The shape of the top 305 may efficiently trap vapors that rise within a sink basin. When the sink cover 300 is turned upside-down, the rounded top 305 of the sink cover 300 may be drained from one or more drainage holes that are in the upper end of the top 305. Drainage holes, which are not shown in FIG. 3, may be plugged by a stopper when the sink cover 300 is not being drained of liquid.

The top 305 may be made of various materials. In an exemplary embodiment, the top 305 comprises a soft material such as rubber or silicone. In various embodiments, the top 305 comprises a harder material such as a polyurethane polymer, wood, or metal. Further, the top may comprise a combination thereof.

In various embodiments, the top 305 may comprise different shapes that cover a sink basin. In an exemplary embodiment, the top 305 may include a flat portion that may be used as a countertop. Various kitchen items may be placed on the flat portion to make efficient use of space in the kitchen. In one example of use, a cutting board may be built into the top 305 of the sink cover 300. Thus, food may be prepared on the top 305 of the sink cover 300 when the sink cover 300 is placed over a sink basin.

The lip 310 of the sink cover 300 may prevent the sink cover 300 from being inserted past the point where the lip 310 meets a rim of a sink basin. In the embodiment shown in FIG. 3, the lip 310 extends around a circumference of the sink cover 300. The lip 310 may comprise various shapes and sizes. For instance, the lip 310 may be larger, smaller, have sharper edges, or have smoother edges than the lip 310 in FIG. 3. The size of the lip 310 may be a horizontal distance from the edge 315 of the sink cover 300 to a part of the lip 310 that is furthest from the edge 315 in the horizontal direction.

In various embodiments, the lip 310 may not be the same size and shape around the circumference of the sink cover 300. In an example of the embodiment, the lip 310 may not extend over an area where a faucet of a kitchen sink is positioned, thus allowing space for a kitchen faucet. In another example of the embodiment, the lip 310 may only exist on sides of the sink cover 300 and not on the front and back. In yet another embodiment of the sink cover 300, the lip 310 is on the sides and front of the sink cover 300, but not on the back of the sink cover 300 so to allow space for the kitchen faucet.

In various embodiments, one side of the lip 310 of the sink cover 300 may extend farther than other sides of the sink cover 300. For example, a lip 310 may extend farther out from the edge 315 on the sides than one the front and back of the sink cover 300. In an exemplary embodiment, the sink cover 300 may be shaped to cover a portion of a kitchen, such as a kitchen sink that has two basins with a divider. Where a sink has more than one basin, the sink cover 300 may be shaped to cover one or more basins. The sink cover 300 may be configured to cover all basins of the multiple basin sink or a subset of the mu multiple basins. Accordingly, the lip 310 and edges 315 of the sink cover 300 may not be symmetrically aligned from side to side. The lip 310 of various sink covers 300 may have variable height to account for a rim of a kitchen sink basin that changes height. For instance, the rim of the basin may be lower where the kitchen sink is divided into two or more basins. The rim of the divider is often lower than the rim around the circumference of a sink. Thus, the position of the lip 310 on the sink cover 300 may be adjusted to fit a basin rim that has a variable height.

As the sink cover 300 may be placed to cover a single basin in the sink that has many basins, additional uses of the sink may be exercised. For example, edible food may be placed in one sink basin and covered by the sink cover 300 while the other sink basin is used to clean kitchenware. As used herein, kitchenware refers to plates, dishes, cookware, utensils, including but not limited to forks, spoons, knives, pots, pans, griddles, cups pitchers, bowls, or any kitchen oriented item or device that is customarily placed or washed in a kitchen sink. Food that is to be eaten may be placed in a kitchen sink for various purposes such as soaking, thawing, marinating, hydrating, and cooking via a sous vide method. By covering the edible food, a risk of contaminating the food while washing kitchenware is greatly reduced. Further, the food may be safe from most electromagnetic radiation such as visible light and UV light, which can significantly affect food depending on the period of time that it is stored.

The edge 315 of the sink cover 300 makes contact with a side of a rim of the kitchen sink. The edge 315 helps guide the sink cover 300 into place and holds the sink cover 300 while the sink cover 300 is placed over a sink basin. Like the top 305 and lip 310, the edge 315 may comprise various shapes and sizes. The edge 315 may form a seal of against a rim of a kitchen sink, which both holds the sink cover 300 in place and seals contents of a sink basin from the rest of a kitchen.

In the exemplary embodiment shown in FIG. 3, the edge 315 wraps around a circumference of the sink cover 300. However, in various embodiments, the edge 315 may not wrap all the way around the sink cover 300. For example, the edge 315 may be included at sides of the sink cover 300 and not included at the corners of the sink cover 300. Conversely, the edge 315 may be included only at the corners of the sink cover 300 whereby the sink cover 300 would not have an edge 315 on the sides.

The lip 310 may have different dimensions around the sink cover 300. Similarly, the edge 315 may extend to various heights around the circumference of the sink cover 300. For example, in cases where the sink cover 300 is shaped to cover a basin in a sink that is divided into many basins, the edge 315 may extend to a different length in a portion of the edge 315 that makes contact with a sink divider compared to where the edge 315 makes contact with an outside portion of a sink.

In various embodiments, the edge 315 may be made of a soft material that can effectively make a seal such as rubber or silicone. Similarly, the top 305 and lip 310 portions of the sink cover 300 may comprise a soft material such as silicone or rubber. In various embodiments, the edge 315 may be made of a hard material that allows the sink cover 300 to stand when the sink cover 300 is placed on a hard and flat surface.

Figure 4:
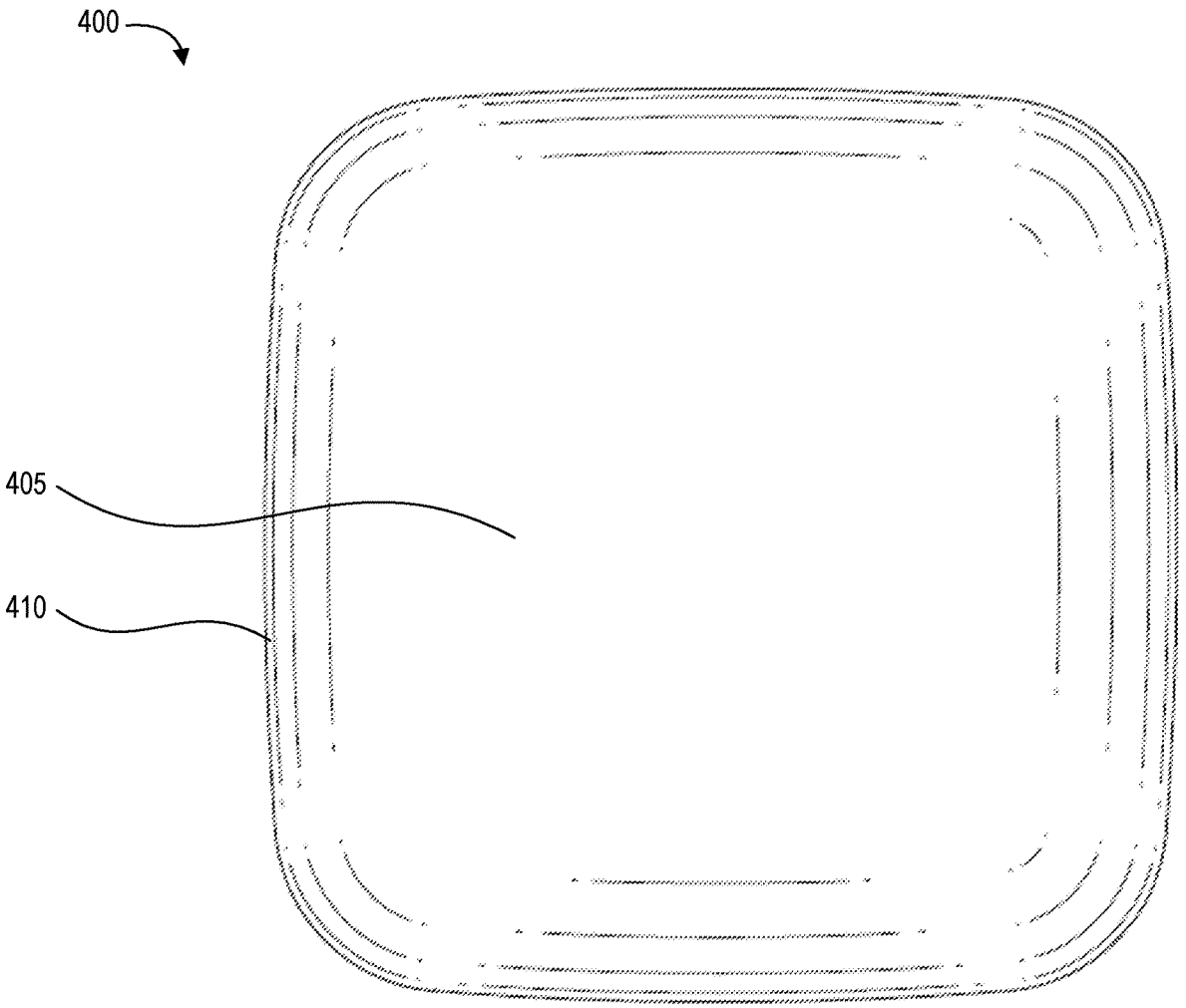
FIG. 4 is an illustration of a top view of the sink cover.

Referring to FIG. 4, FIG. 4 is an illustration of a top view of the sink cover 400. The sink cover 400 from the top view may have various shapes that may approximate the shape of a sink basin. Accordingly, the sink cover 400 may be dimensioned to fit the many possible shapes of a sink basin. For instance, the square shape of the sink cover 400 that is shown in FIG. 4, may be elongated or reduced in the vertical and/or horizontal directions to fit a rectangular sink basin.

The top 405 of the sink cover 400 covers a sink basin while the lip 410 extends over the rim of a sink basin. The top may be shaped into a convex shell or other shapes such as a flat top. In an exemplary embodiment, the top is made of a hard flat material that is suitable to allow for items to be placed on the sink cover 400. Items, such as food that is being prepared could be placed on the top 405 while the sink cover 400 is positioned over a sink basin.

The lip 410 extends beyond the rim of a sink basin and prevents the sink cover 400 from being lowered into the sink basin past a point. While the edges of the sink cover 400 must conform to the shape of the rim of the basin, the lip 410 does not. So, while in various embodiments, the shape of the lip 410 around the circumference of the sink cover 400 matches the shape of the rim, the lip 410 of other embodiments may not match the shape of the rim. In an exemplary embodiment, the shape of the lip 410, which is shown from the top view, does not conform to the shape of the rim of the sink basin. Accordingly, the square shape of the sink cover may cover a basin that is not a square shape. For instance, a sink cover 400 may include edges that fit an oval shape sink basin, but a lip 410 with a square shape.

Figure 5:
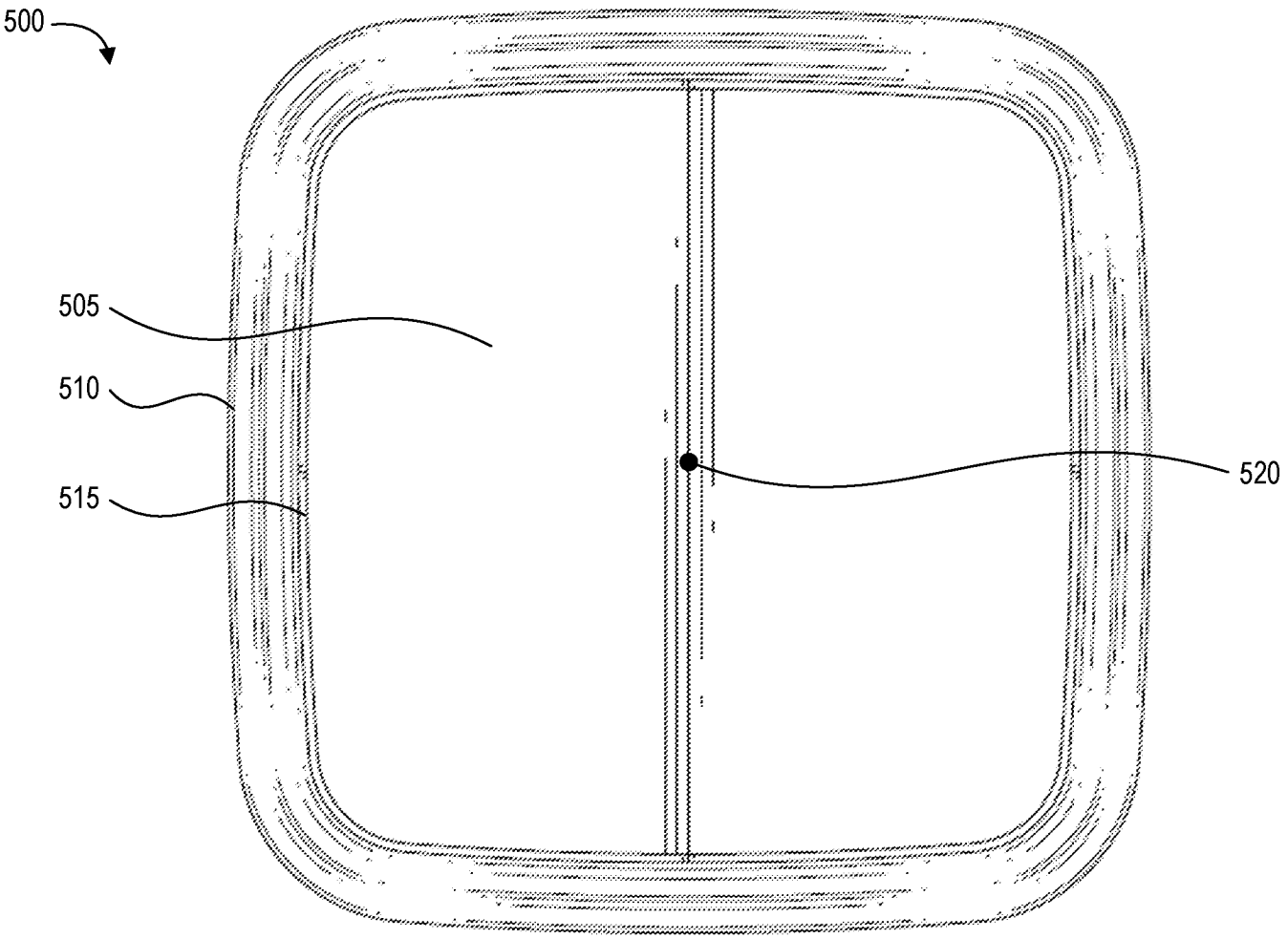
FIG. 5 is an illustration of a bottom view of the sink cover.

Referring to FIG. 5, FIG. 5 is an illustration of a bottom view of the sink cover 500. The bottom of the sink cover 500 is exposed to the contents of a sink basin when the sink cover 500 is placed over the sink basin. The top 505 of the sink cover 500 covers the contents of the sink basin. Air inside the sink cover may be substantially trapped so that very little air circulates back and forth between the inside and outside of the sink cover 500 as it is placed over a sink basin.

In various embodiments, the top 505 may be used to trap air and insulate the inside space of the sink cover 500 from the outside of the sink cover 500. For example, hot food may be placed in a bowl in a sink basin and covered by the sink cover 500. Without circulating air, the hot food may remain hot for a longer period of time than food that is placed outside of the sink cover 500.

To determine an approximate heat of the sink cover 500, the sink cover 500 may include a thermometer. In various embodiments, the sink cover 500 may include a pigment that changes color based on a temperature of the sink cover 500. The composition of the sink cover 500 may include a thermochromic compound, such as spiropyran, that changes color based on a temperature of the composition. In various embodiments, the sink cover 500 may be configured to change color when the sink cover 500 is above a temperature. A user may use color change of the sink cover 500 to estimate a temperature of the contents of the sink basin.

The edge 515 is configured to be inserted inside a sink basin and make contact with the rim while the lip 510 is configured to extend over the rim of the sink basin. Thus, for all angles, the distance of the lip 510 from the center 520 of the sink cover 500 is greater than the distance of the edge 515 from the center 520 of the sink cover 500.

Figure 6:
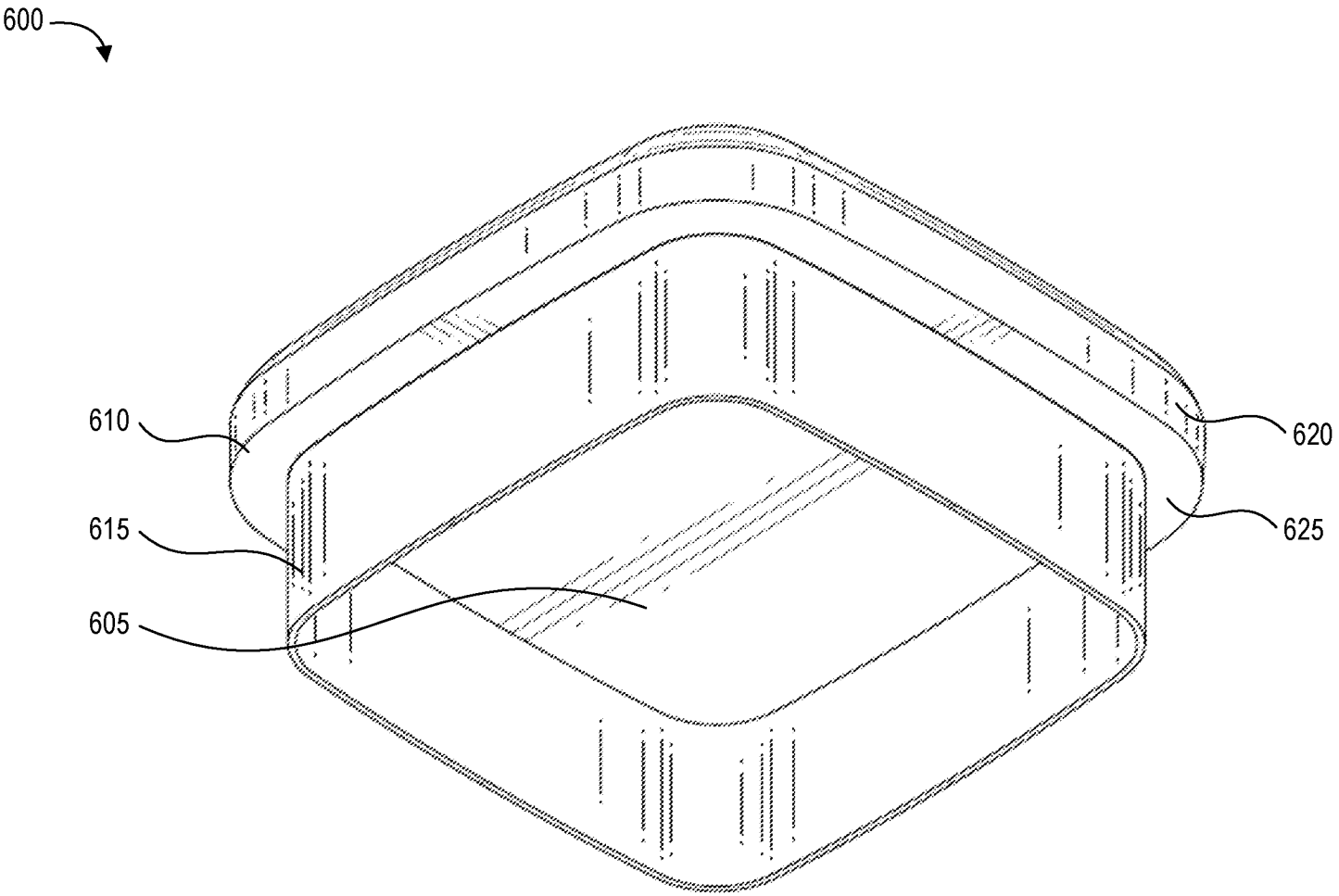
FIG. 6 is an illustration of a bottom perspective view of another embodiment of the sink cover.

Referring to FIG. 6, FIG. 6 is an illustration of a bottom perspective view of another embodiment of the sink cover 600. The various parts of the sink cover 600, including the top 605, lip 610, and edge 615, may comprise various shapes. The embodiment shown in FIG. 6 of a sink cover 600 has a lip 610 shape that differs from the embodiment of a lip 210 that is shown in FIG. 2. Whereas the lip 210 in FIG. 2 is rounded, the lip 610 shown in FIG. 6 is flat on a bottom 625 of the lip 610 and flat on the side 620 of the lip 610. The junction between the bottom 625 and side 620 of the lip 610 makes a sharp corner.

The embodiment of the sink cover 600 shown in FIG. 6 may create a seal over sinks where the area around the rim of the sink basin is flat. Further, the flat side 620 of the lip 610 may allow the sink cover 600 to fit with surrounding objects such, as walls, that have flat sides.

Figure 7:
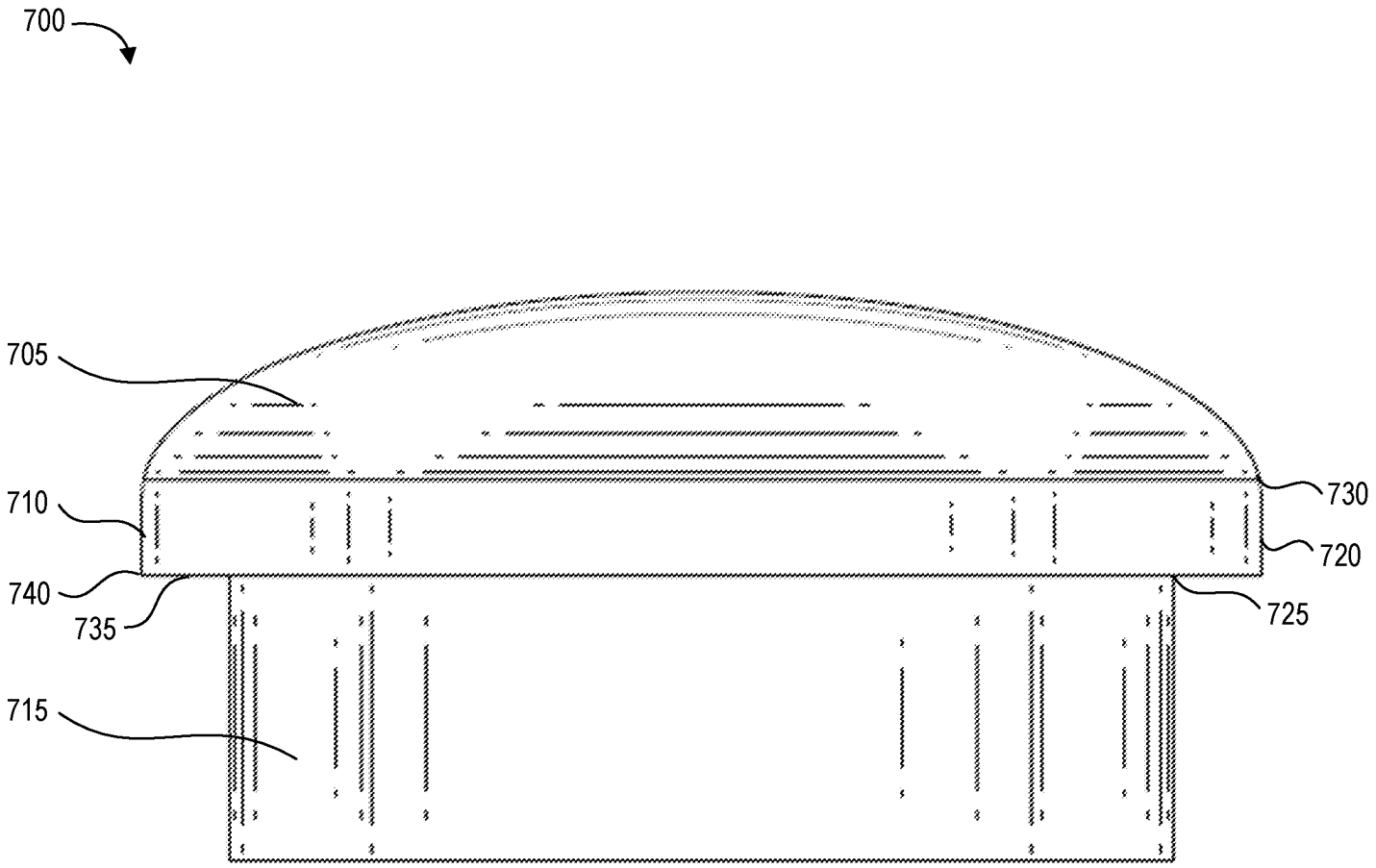
FIG. 7 is an illustration of a side view of another embodiment of the sink cover.

Referring to FIG. 7, FIG. 7 is an illustration of a side view of another embodiment of the sink cover 700. From the side view, the lip 710 of the sink cover 700 has right angles at a transition 725 from the edge 715 to the lip 710 and a transition 740 from the bottom 735 of the lip 710 to the side 720 of the lip 710. Further, the transition 730 from the side 720 of the lip 710 to the top 705 is a corner with an angle of greater than 90 degrees.

In various embodiments, the top 705 of the sink cover 700 is detachable. In one example of a detachable top, the top 705 may detach at the transition 730 between the top 705 and the side 720 of the lip 710. In an exemplary embodiment, the top 705 may detach at the transition 740 between the bottom 735 of the lip 710 and the side 720 of the lip 710.

The detachable top 705 may allow for a user to access the contents of a sink basin without removing the entire sink cover 700. In various embodiments, a first top 705 may be exchanged for a second top 705 after the first top 705 is detached from the sink cover 700. A user may, for instance, exchange contents of the sink basin while the top 705 is detached. In another example of use, a user may fill a sink basin with water while the top 705 is in a detached state.

Figure 8:
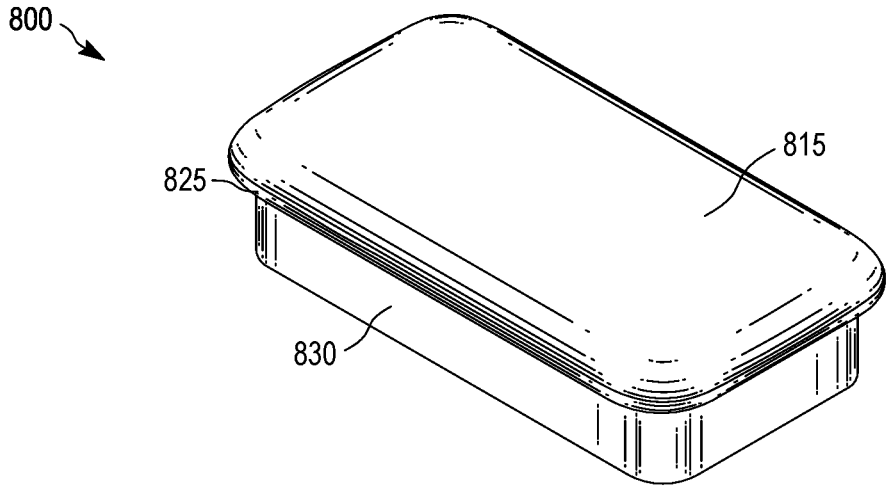
FIG. 8 is an illustration of a sink cover as it is about to be inserted into a sink.
Figure 8:
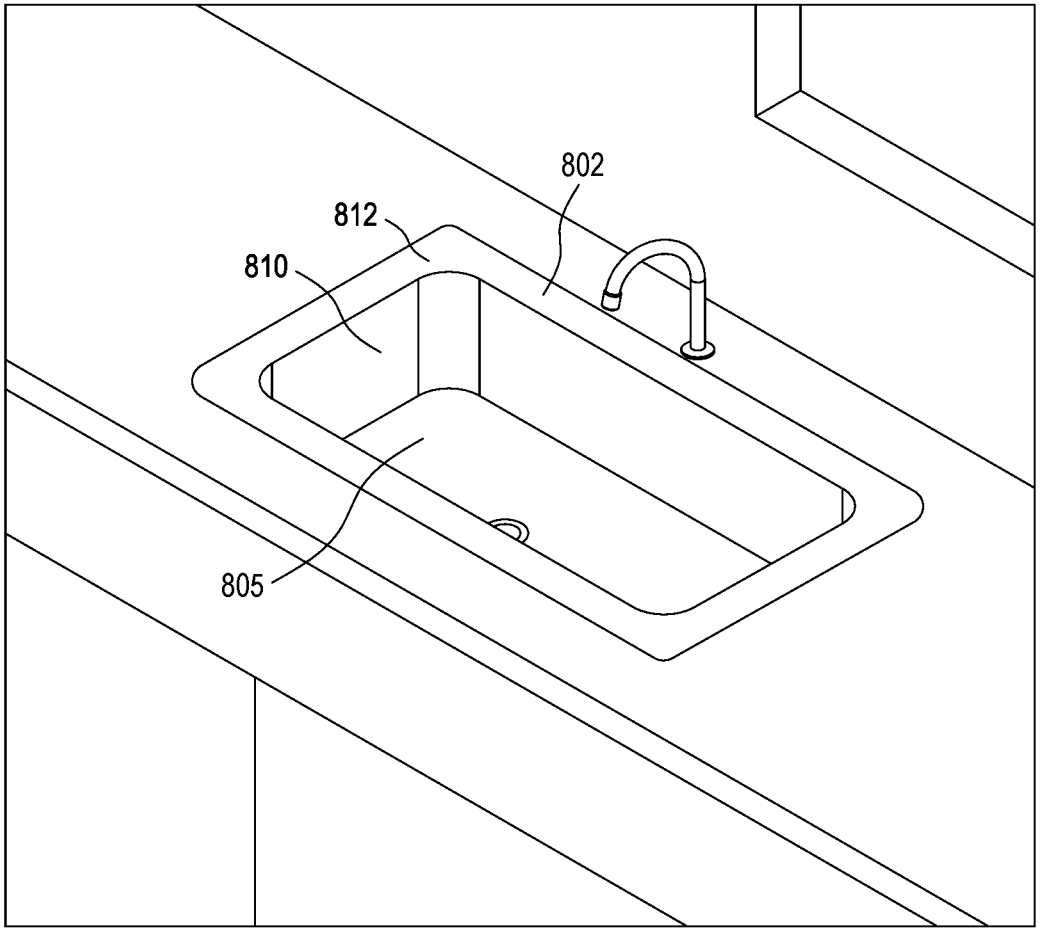

Referring to FIG. 8, FIG. 8 is an illustration 800 of a sink cover 815 as it is about to be inserted into a sink 802. The sink cover 815 may be used to cover a sink 802 for various purposes including, but not limited to sealing the sink basin 805 so the air inside the sink basin 805 cannot circulate outside of the sink cover 815, protecting food that is placed in the sink basin 805, preventing the movement of pathogens into and out of the sink basin 805, insulating the contents of the sink basin 805, and restricting view of the contents of the sink basin 805.

The sink cover 815 may be placed into the sink by aligning the edge 830 of the sink cover 815 with the inner rim 810 of the sink basin 805. Once the edge 830 is aligned, the sink cover 815 may be lowered into the sink basin 805 until the lip 825 makes contact with the area 812 outside of the rim.

Figure 9:
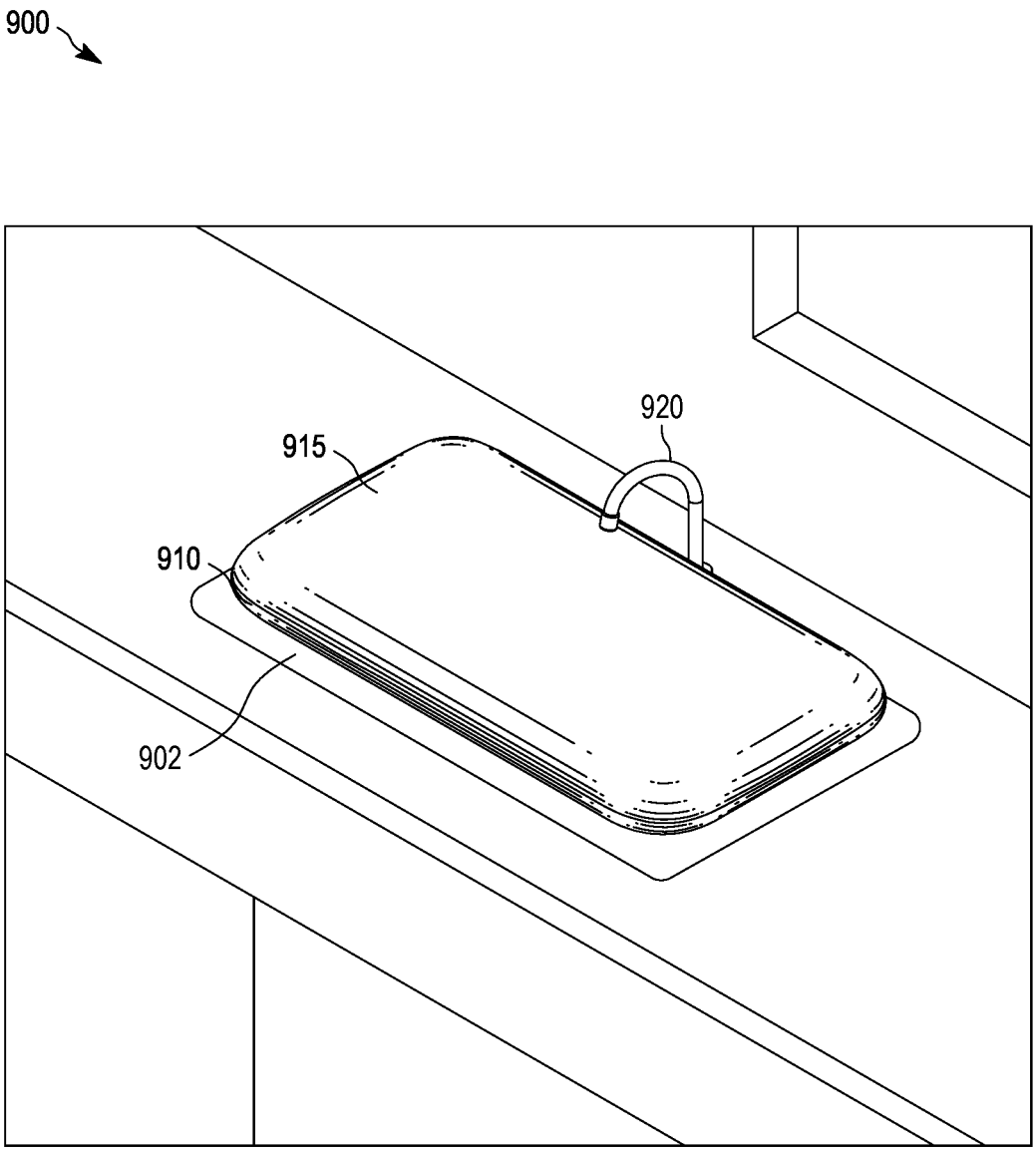
FIG. 9 is an illustration of a sink cover that is inserted into a sink to cover the basin of the sink.

Referring to FIG. 9, FIG. 9 is an illustration 900 of a sink cover 915 that is inserted into a sink 902 to cover the basin of the sink 902. As shown in FIG. 9, the sink cover 915 may cover and obscure the sink basin. Accordingly, the contents of the sink basin cannot be seen when the sink cover 915 is in place. Potentially offensive contents of the sink basin, such as unclean kitchenware, may be hidden from view in a kitchen area. Further, the unclean kitchenware may be segregated from other objects in a kitchen such as food, clean kitchenware, insects, and children.

The sink cover 915 may be sized to fit the many potential sizes of sink basins. As such, the sink cover 915 shown in FIG. 9 has a rectangular cross section with curved corners to fit the sink basin. In various embodiments, the lip 910 of the sink cover 915 may be sized such that there is room for the lip 910 to fit in between the faucet 920 and the inner rim of the sink basin.

Figure 10:
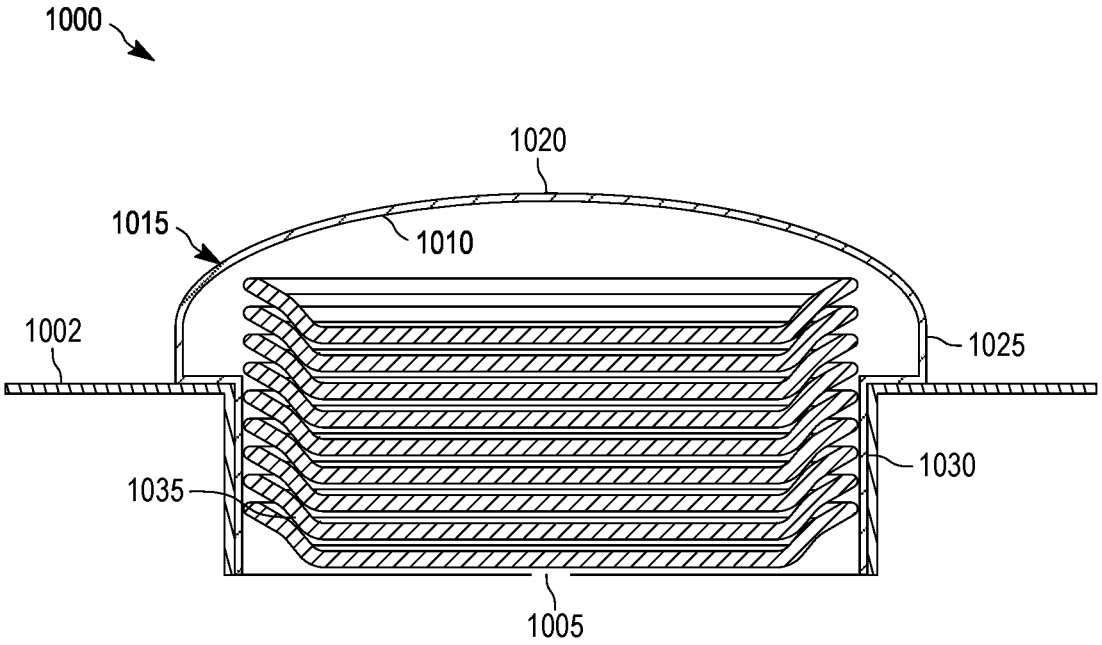
FIG. 10 is a cross section view of the sink cover that is inserted into a sink.

Referring to FIG. 10, FIG. 10 is a cross section 1000 view of the sink cover 1015 that is inserted into a sink 1002. As shown in FIG. 10, the sink cover 1015 is placed over a sink basin 1005 of a sink 1002. The edge 1030 of the sink cover 1015 is in contact with an inner rim 1010 of the sink basin 1005, which secures the sink cover 1015 to the sink basin 1005 and prevents the sink cover 1015 from moving horizontally in a left or right direction.

The lip 1025 of the sink cover 1015 extends beyond the inner rim 1010 and prevents the sink cover 1015 from penetrating lower into the sink basin 1005. Whereas the edge 1030 is sized to fit the dimensions of the sink basin 1005, the lip 1025 does not have that restriction. Instead, the lip 1025 may be restricted based on objects in a kitchen area just beyond the rim of the sink basin 1005. For instance, the sink faucet may restrict the dimensions of the lip on one side of the sink cover 1015.

The contents of the sink basin 1005 may include various substances and objects. As shown in FIG. 10, the sink basin 1005 contains kitchen plates 1035. Kitchenware that is clean may be stored within the sink cover 1035 to prevent the clean kitchenware from being contaminated. Alternatively, soiled kitchenware may be segregated from an otherwise clean area of a kitchen for both sanitary and aesthetic reasons.

In various embodiments, the top 1020 of the sink cover 1015 is detachable. Once detached, one may have access to the contents of the sink basin 1005, such as the plates 1035 shown in FIG. 10. In one use case, hot water may be added to the sink basin 1005 with the plates 1035 when the top 1020 is detached. The top 1020 may be reattached after the sink basin 1005 is full of hot water, thus insulating air within the sink basin 1005. In addition to being insulated from outside air, the air inside the sink basin 1005 with hot water may contain hot water vapor. Accordingly, the contents of the sink basin 1005 with hot water may be thermally treated with hot water more effectively than without the sink cover 1015.

As disclosed herein, the sink cover 1015 may include a thermochromic compound that changes color responsive to a temperature of the sink cover 1015. Thus, a temperature of water inside the sink basin 1005 may be monitored based on a color of the sink cover 1015. In a use case, contents of the sink basin may be soaked in hot water until the color of the sink cover 1015 indicates that the water inside the sink basin 1005 is cool.

Figure 11:
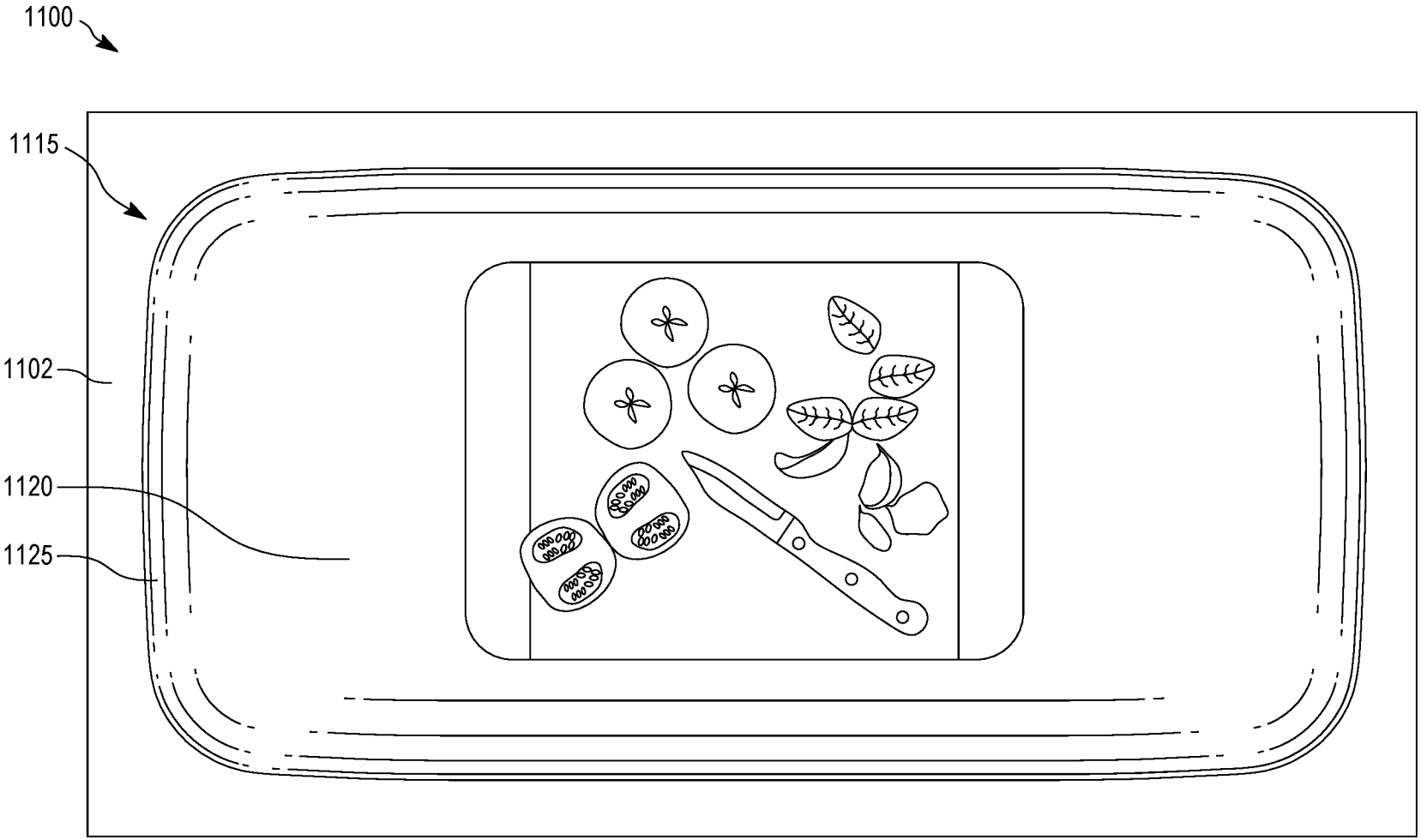
FIG. 11 is an illustration of yet another embodiment of a sink cover that is inserted into a sink.

Referring to FIG. 11, FIG. 11 is an illustration 1100 of yet another embodiment of a sink cover 1115 that is inserted into a sink 1102. In various embodiments, portions of the sink cover 1115 may be made out of hard materials. In an exemplary embodiment, the entire sink cover 1115 is made out of a material that is hard enough to allow the sink cover 1115 to stand on its own without collapsing when the sink cover 1115 is placed on a flat surface.

In the embodiment shown in FIG. 11, the top 1120 of the sink cover 1115 is flat. Further, the lip 1125 and top 1120 of the sink cover 1115 are made of a hard material that allows objects to be placed onto the flat top 1120 of the sink cover 1115 without the sink cover 1115 collapsing. When the sink cover 1115 is placed over a sink basin, as shown in FIG. 11, the weight of the sink cover 1115 is supported by the lip 1125, which is supported by the area outside the inner rim of the sink basin.

Where the lip 1125 and top 1120 are made of sufficiently hard material, such as a hard plastic, the flat area on the top 1120 of the sink cover 1115 may be utilized as a cutting surface, which increases the usable space in a kitchen area. In various embodiments, the top 1120, which may be used as a cutting surface, is detachable and allows for easy cleaning of the top 1120 after use as a cutting surface.

Figure 12:
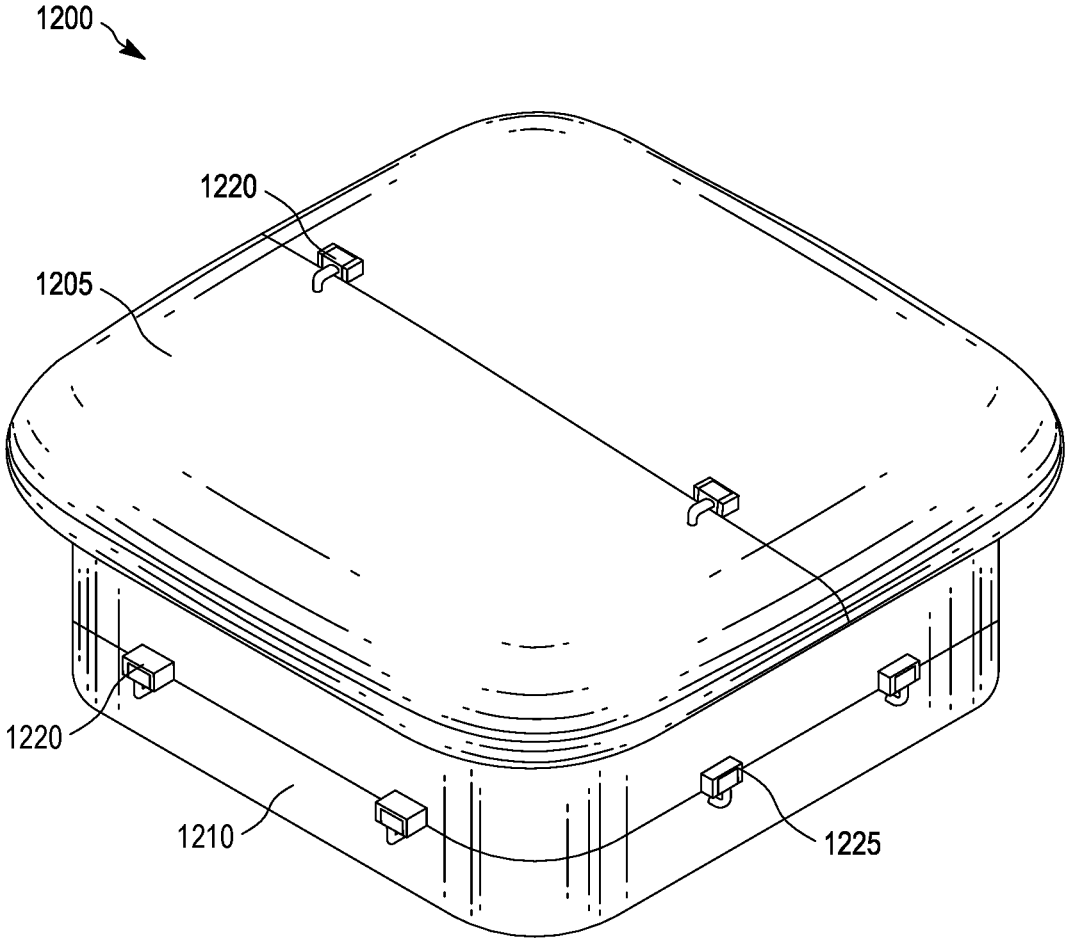
FIG. 12 is an illustration of an embodiment of a sink cover that folds.

Referring to FIG. 12, FIG. 12 is an illustration of an embodiment of a sink cover 1200 that folds. The sink cover 1200 may include one or more hinges that allow the sink cover 1200 to fold. By folding, the sink cover 1200 may be easily stored and washed.

In the embodiment shown in FIG. 12, the top 1205 of the sink cover 1200 includes a hinge 1220 that allows the sink cover 1200 to fold across the top 1205. The hinge 1220 may be placed at various portions of the sink cover 1200 based on the space needs of the user. A hinge 1220 may allow the edge 1210 to be folded on a side of the sink cover 1200. On the adjacent side of the edge 1210, another hinge 1225 may allow the adjacent side of the edge 1210 to be folded.

Figure 13:
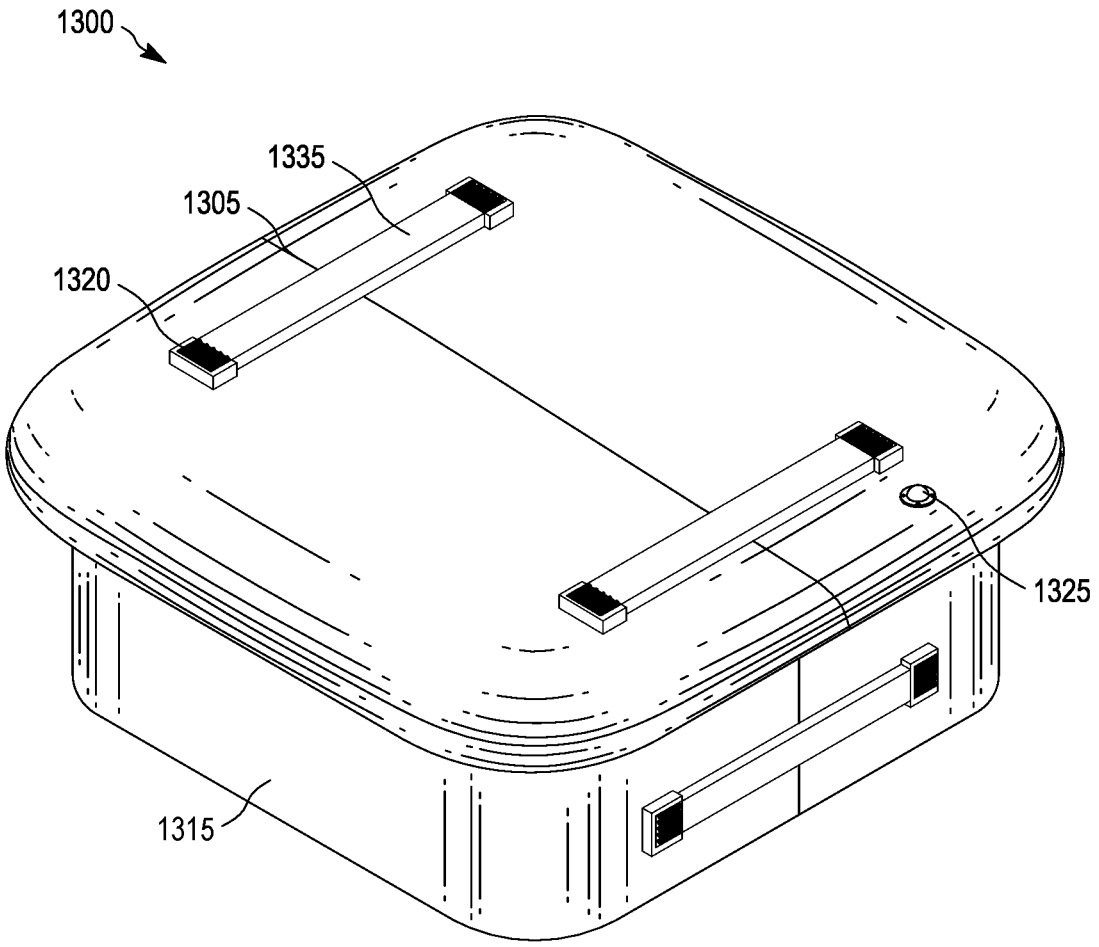
FIG. 13 is an illustration of yet another embodiment of a sink cover that extends to modify its dimensions.

Referring to FIG. 13, FIG. 13 is an illustration of yet another embodiment of a sink cover 1300 that extends to modify its dimensions. As kitchen sink basins may vary greatly in size and shape, the sink cover 1300 may be capable of adjusting its size and/or shape. The embodiment of the sink cover 1300 shown in FIG. 13 includes a telescoping mechanism that allows the sink cover 1300 to be extended in one dimension.

The telescoping mechanism 1335 comprises an outside portion and an inside portion, where the inside portion slides within the outside portion. Various embodiments that are not shown may allow the sink cover 1300 to be adjusted in other dimensions and to change shape. The telescoping mechanism 1335 binds portions of the sink cover 1300 that are separated by a seam 1305 to one another and allows them to slide, which modifies the shape of the sink cover 1300. A spring 1320 may apply force to extend the telescoping mechanism 1335. Accordingly, the spring 1320 may apply a force to extend the edge 1315 against the inner rim of a sink basin when the sink cover 1300 is placed over the sink basin.

The spring 1320 may be connected to a button 1325, that when depressed, prevents the spring 1320 from applying force to extend the sink cover 1300. In an exemplary embodiment, the button 1325 may be depressed to retract the sink cover 1300 and released to extend the sink cover 1300.

Figure 14:
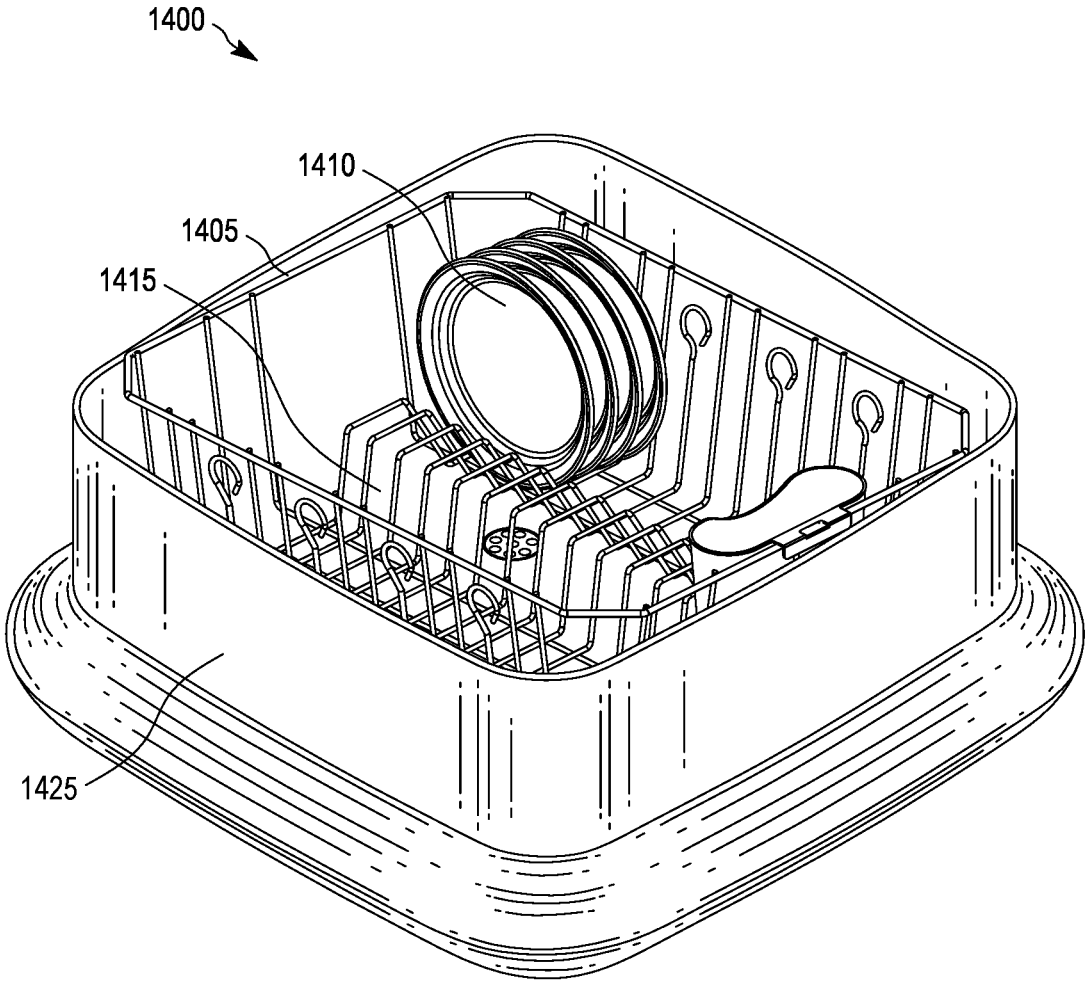
FIG. 14 is an illustration of an upside-down sink cover that holds kitchenware.

Referring to FIG. 14, FIG. 14 is an illustration of an upside-down sink cover 1400 that holds kitchenware 1410. The sink cover 1400 may be used to hold objects, such as kitchenware 1410, to be cleaned when the sink cover 1400 is turned upside down. The underside 1415 of the top of the sink cover 1400 may include one or more slots 1405 that are shaped to hold kitchenware, such as plates.

In a use case, a user may turn the sink cover 1400 upside down and position it at a space where the user wishes to soak objects such as kitchenware. In one example, a user may place the upside-down sink cover over the rim of a sink basin. For instance, a user may place the upside down sink cover 1400 over a sink basin when the sink basin is already full.

Water may be added to the upside-down sink cover 1400 to clean kitchenware 1410 or other objects. In various embodiments, the sink cover 1400 is sealed and is capable of holding a volume of water up to the top of the edge 1425. Further, the sink cover 1400 may include one or more drainage holes 1430 that may be opened to drain water from the sink cover 1400. A plug may be inserted into the drainage hole 1430 to seal the sink cover from leaking.

Figure 15:
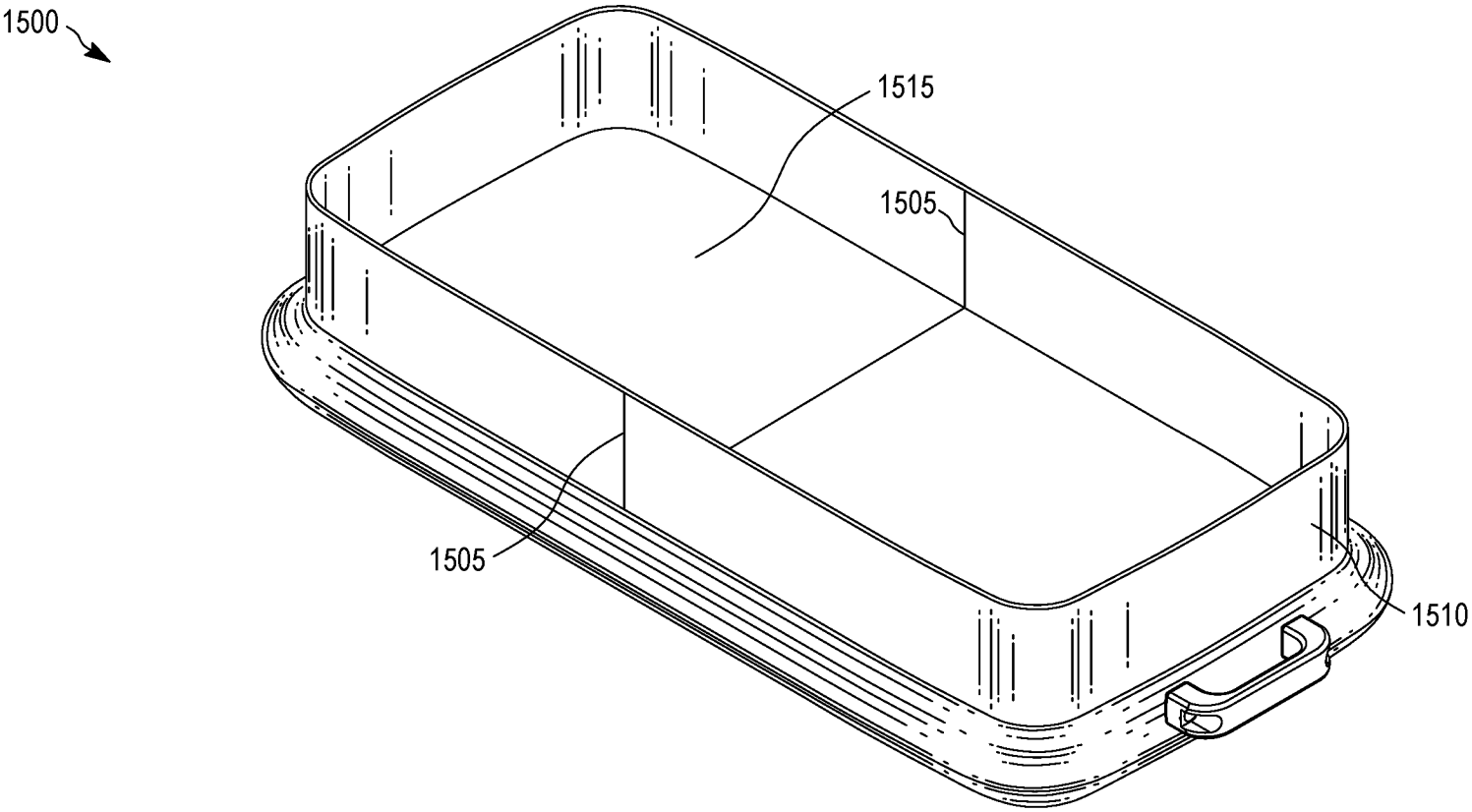
FIG. 15 is another illustration of an embodiment of a sink cover that folds.

Referring to FIG. 15, FIG. 15 is another illustration of an embodiment of a sink cover 1500 that folds. The illustration shows an underside 1515 of the sink cover 1500, which is configured to be exposed to the contents of a sink basin. The exemplary embodiment shown in FIG. 15 includes a folding portion 1520 that folds, thus saving space when the sink cover 1500 is not in use and when the sink cover 1500 is being cleaned. Further, the sink cover 1500 may be folded while it is positioned over a sink to uncover a portion of the sink.

The sink cover 1500 may further include one or more handles 1510 that facilitate carrying the sink cover 1500. In the exemplary embodiment of the sink cover 1500, which folds, the one or more handles 1510 may be advantageously positioned for carrying the sink cover 1500 while it is in a folded state. The sink cover 1500 may include a seam 1505 on the edge of the folding portion 1520 that is configured to be separated when the sink cover 1500 is in a folded state.

Figure 17:
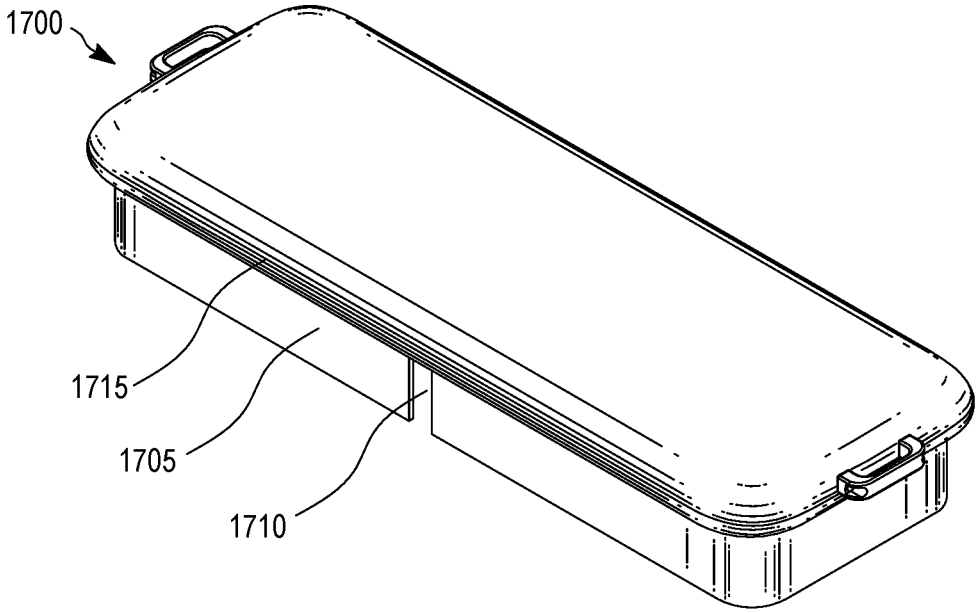
FIG. 17 is a sink cover that is configured to cover the sink shown in FIG. 16.
Figure 17:
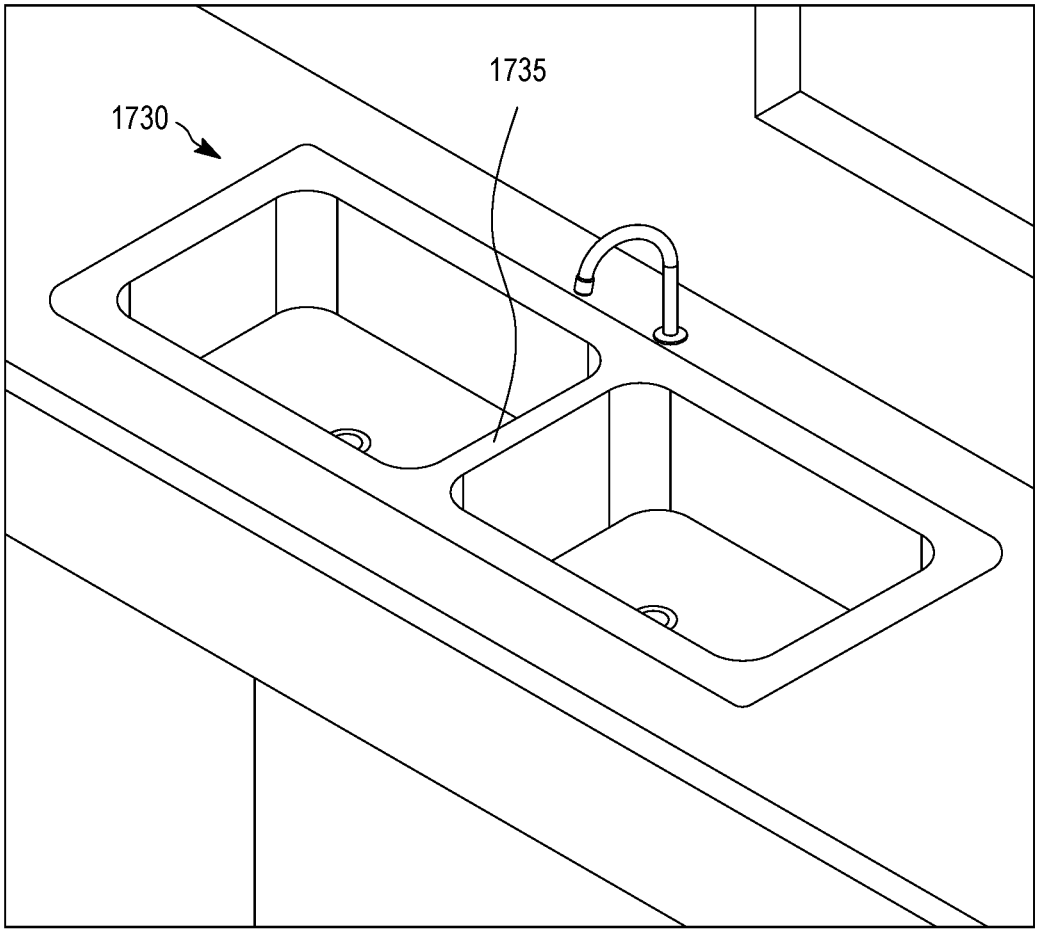

Various sink basins are divided into one or more separate sinks. As such, the divided sink basin includes a barrier that divides the separate sinks of the sink basin. The seam 1505 may be configured to conform to a shape of the barrier when the sink cover 1500 is in an unfolded state. In various embodiments, which are not shown in FIG. 15, the seam 1505 is shaped to conform to a barrier and does not completely close to make a contiguous edge when the sink cover 1500 is in an unfolded state. In various embodiments, the seam 1505 is made of a material that compresses when it is pressed against a sink basin divider, thus conforming to the sink basin. FIG. 17 shows an embodiment of the sink cover that is configured to accommodate a divider. The feature of the embodiment of FIG. 17 to accommodate a divider may be combined with the folding feature of the sink cover shown in FIG. 15.

Figure 16:
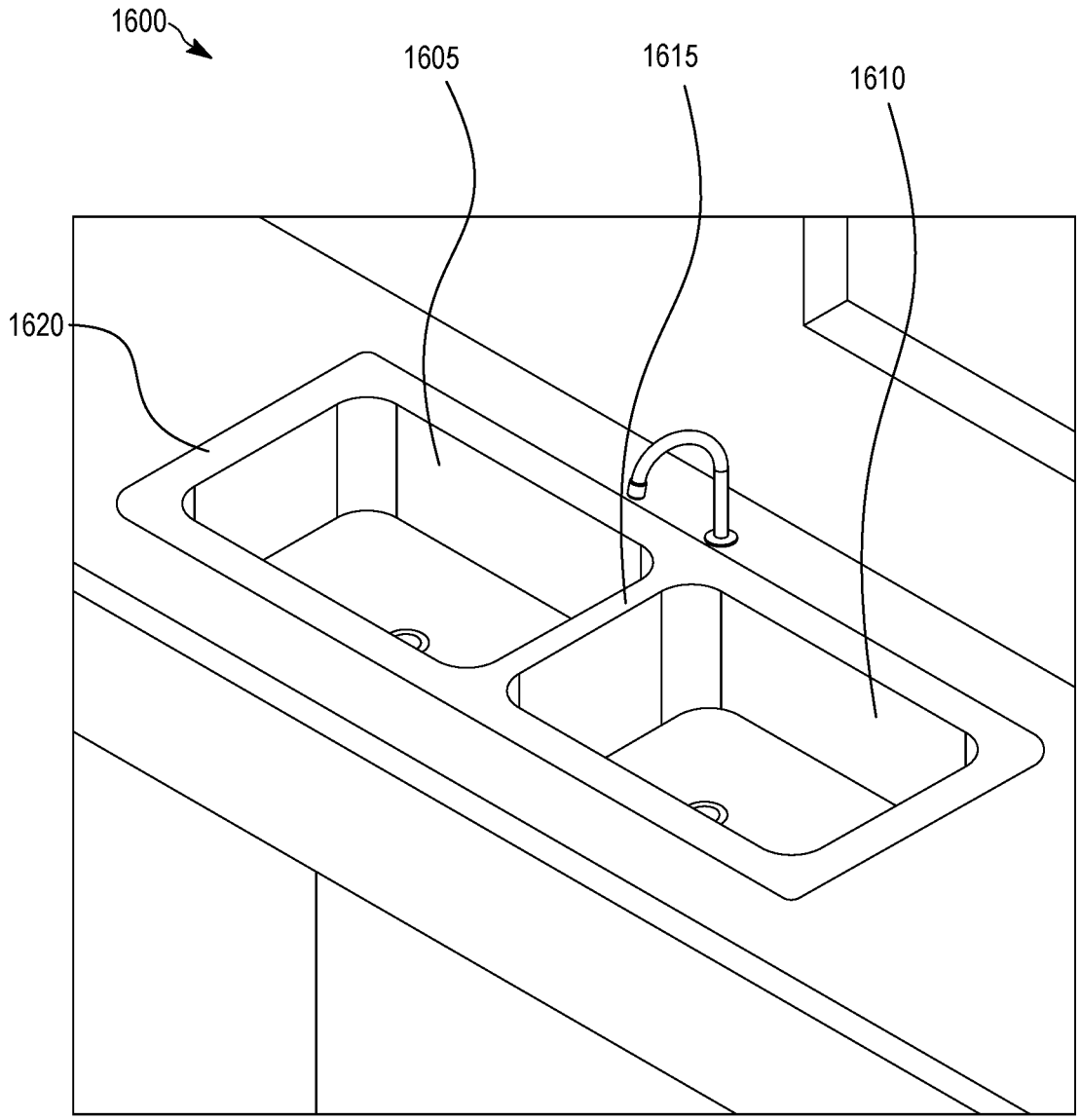
FIG. 16 an illustration of a sink with two sink basins, a first sink basin and a second sink basin.

Referring to FIG. 16 and FIG. 17, FIG. 16 is an illustration of a sink 1600 with two sink basins, a first sink basin 1605 and a second sink basin 1610. FIG. 17 is a sink cover 1700 that is configured to cover the sink 1600 shown in FIG. 16. The sink 1600 includes a divider 1615 between the two sink basins. A rim 1620 that surrounds the sink 1600 is positioned higher than the divider 1615.

Accordingly, a lip 1715 of the sink cover 1700 will not come into contact with the divider 1615 when the sink cover 1700 is placed over the sink 1600. The edge 1705 of the sink cover 1700 includes gaps 1710 to accommodate the divider 1615. As the sink cover 1700 is placed over the sink 1730, the top of the divider 1735 fits inside the gaps 1710, which allow the edge 1705 to straddle either side of the divider 1735. In various embodiments, the edge 1705 comprises a material that is configured to conform to irregular shapes of the divider 1735.

An exemplary embodiment of the foldable sink cover 1500 shown in FIG. 15 includes gaps 1710 shown in FIG. 17. The exemplary foldable sink cover with gaps 1710 may be easily folded to uncover either side of a multiple basin sink. When placed over the sink 1600 shown in FIG. 16, the exemplary foldable sink cover with gaps 1710 may cover both sink basins, folded to only cover the first sink basin 1605, or folded to only cover the second sink basin 1610.

Figure 18:
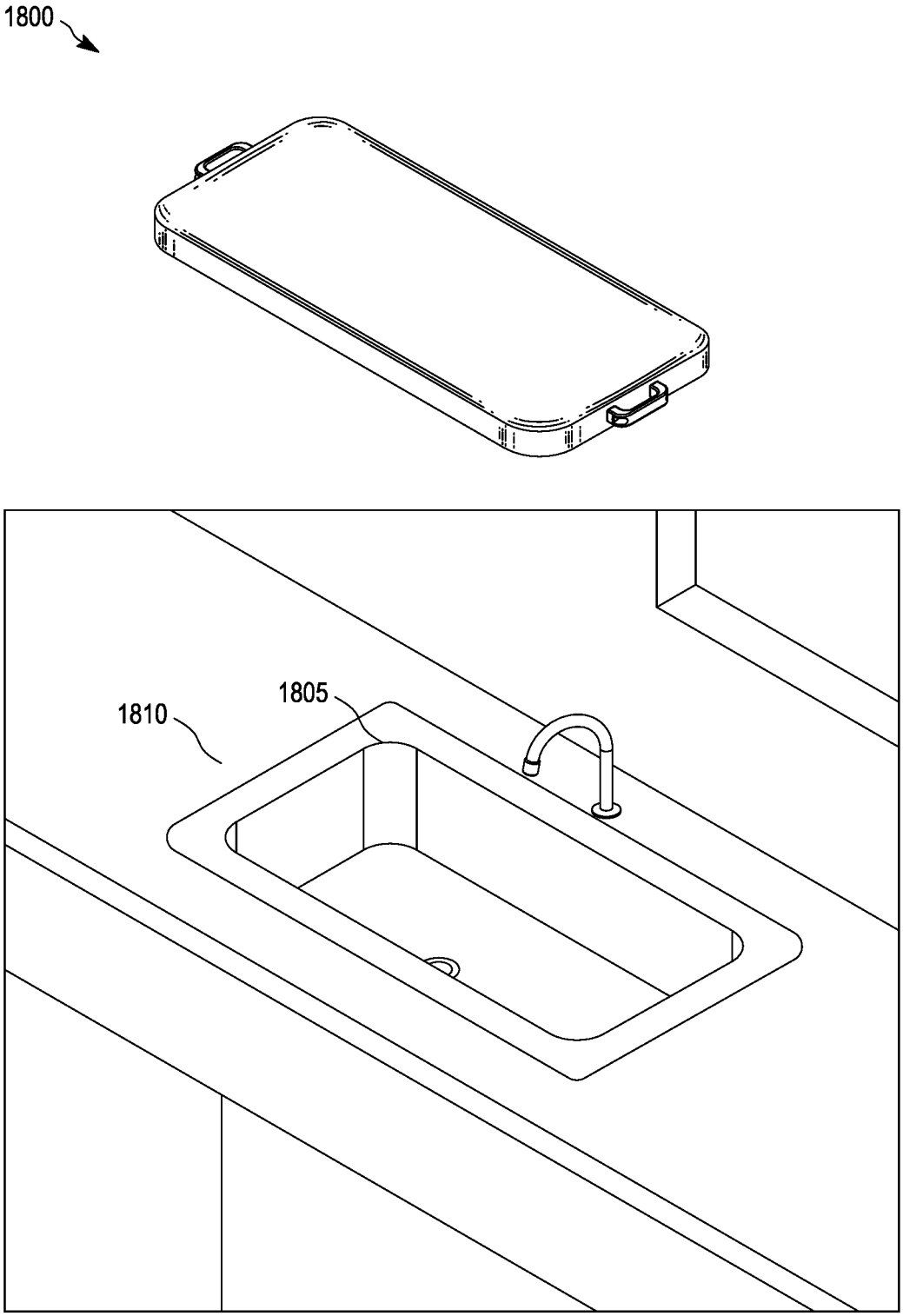
FIG. 18 is an exemplary flat piece embodiment of the sink cover.
Figure 19:
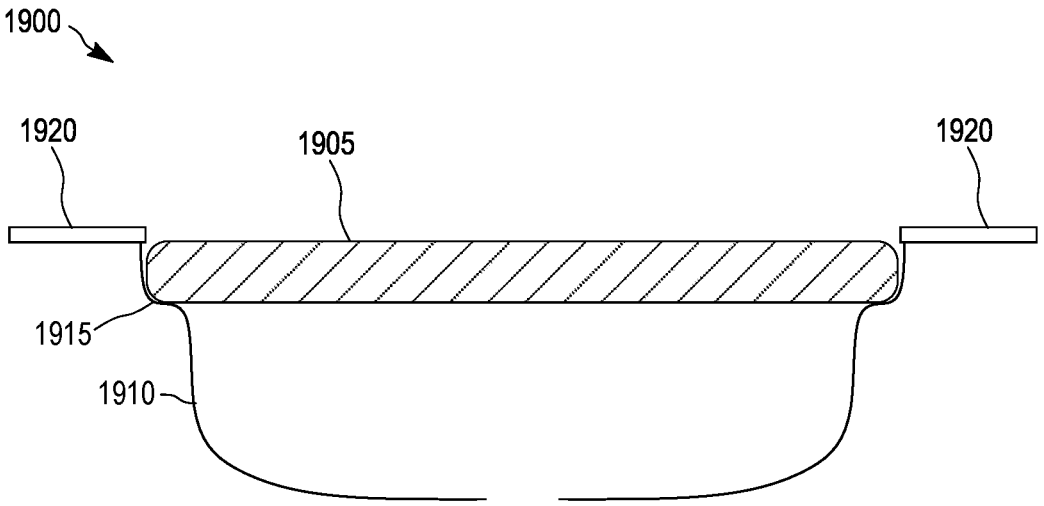
FIG. 19 is a cross section view of the flat piece embodiment of the sink cover.

Referring to FIG. 18 and FIG. 19, FIG. 18 is an exemplary flat piece embodiment of the sink cover 1800. FIG. 19 is a cross section view 1900 of the flat piece embodiment of the sink cover as it covers a sink. The flat piece embodiment does not include the edge 115, but is configured to rest on the shoulder 1805 of the sink basin around a circumference of the sink basin. It comprises a flat plane of material that substantially covers the sink basin. The flat piece embodiment may be shaped to conform to the space between the shoulder of a sink basin and the countertop 1810.

The shoulder 1915, as defined herein, is illustrated in FIG. 19 and is the relatively flat portion of the sink basin that surrounds the relatively vertical sides 1910 of the sink basin. The flat piece embodiment is shaped to rest on the shoulder 1915 within the perimeter of the countertop 1920. Thus, the flat piece embodiment may efficiently seal a sink basin without the edge.

Figure 20:
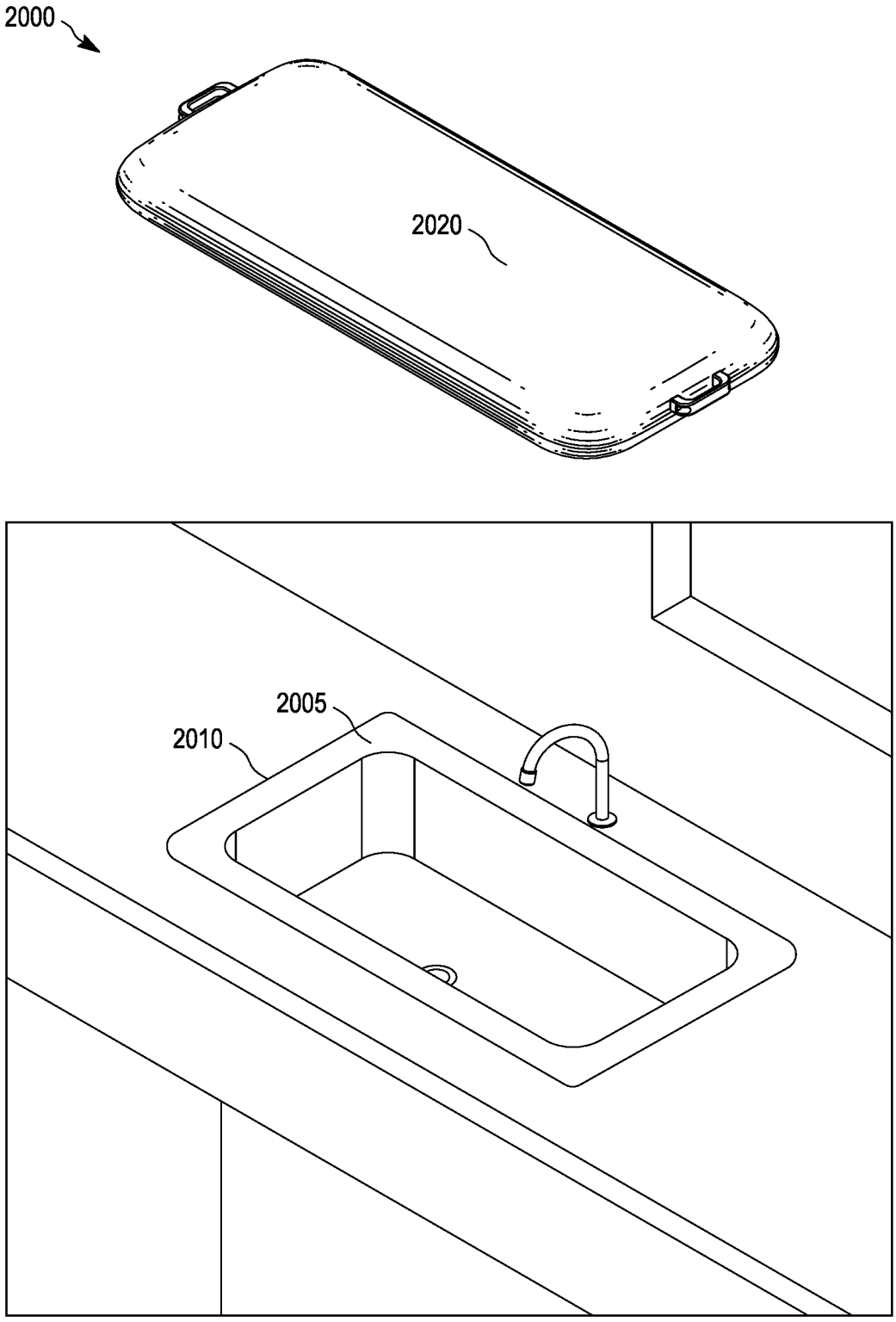
FIG. 20 is an exemplary curved piece embodiment of the sink cover.
Figure 21:
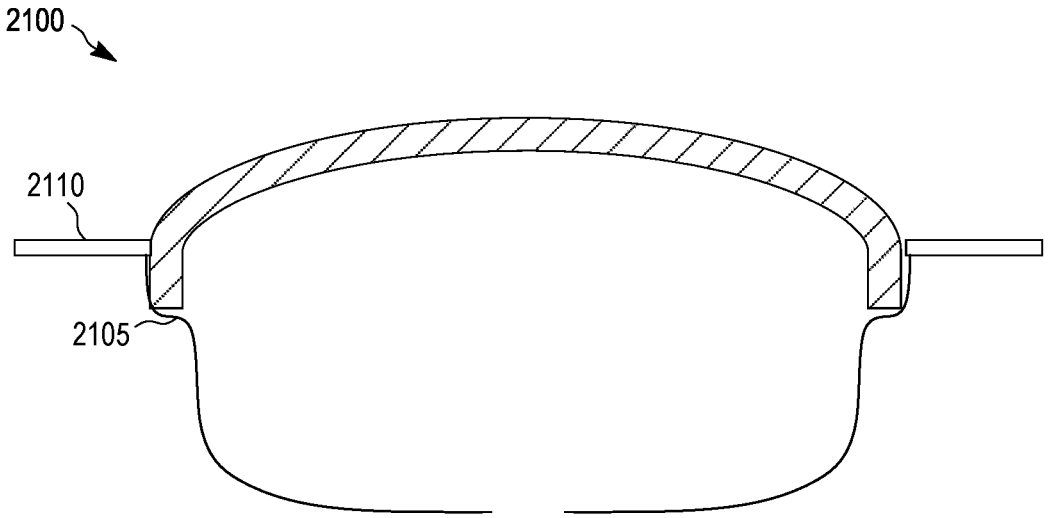
FIG. 21 is a cross section view of the curved piece embodiment of the sink cover.

Variations of the flat piece embodiment are configured to rest on a countertop that surrounds a sink basin. The flat piece embodiment is shaped to cover substantially all of a sink basin, which is herein defined as the volume of a sink basin that is capable of confining Referring to FIG. 20 and FIG. 21, FIG. 20 is an exemplary curved piece embodiment of the sink cover 2000. FIG. 21 is a cross section view 2100 of the curved piece embodiment of the sink cover as it covers a sink. Like the flat piece embodiment of the sink cover that is shown in FIG. 18 and FIG. 19, the curved piece embodiment is shaped to fit on the shoulder 2005 of a sink basin within the perimeter 2010 of a countertop. It comprises a curved plane of material that rises from its side 2015 to its center 2020 from the perspective shown in FIG. 20.

As shown in FIG. 21, the side 2015 rests on the shoulder 2105 of the sink basin within the perimeter of a countertop 2110. The curved shape allows for more volume within the sink basin that can be covered by the curved piece embodiment of the sink cover relative to the flat piece embodiment. Thus, the curved piece embodiment can cover a greater amount of kitchenware or other items such as food within the sink basin.

Figure 22:
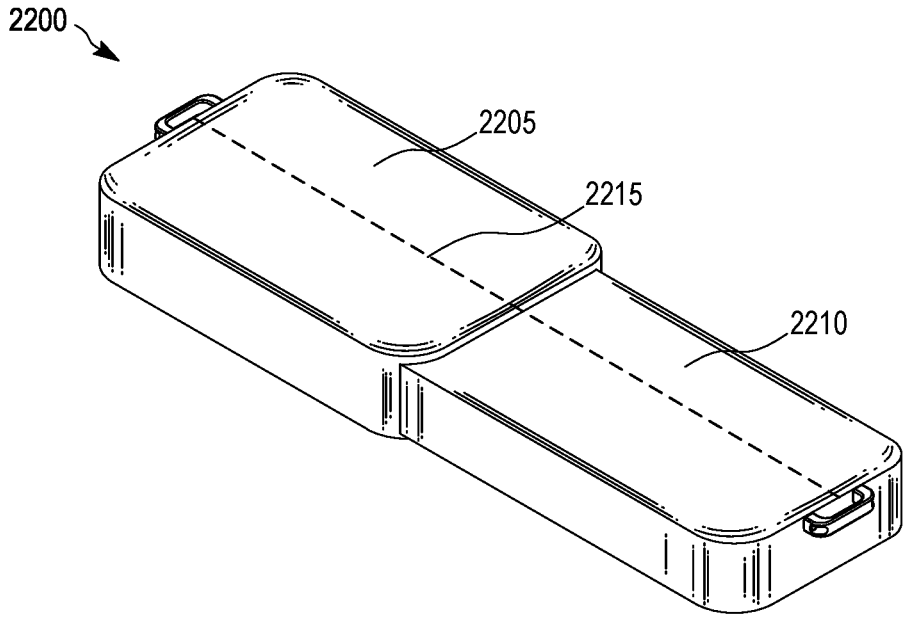
FIG. 22 is an exemplary matchbox embodiment of the sink cover from a top perspective view.
Figure 22:
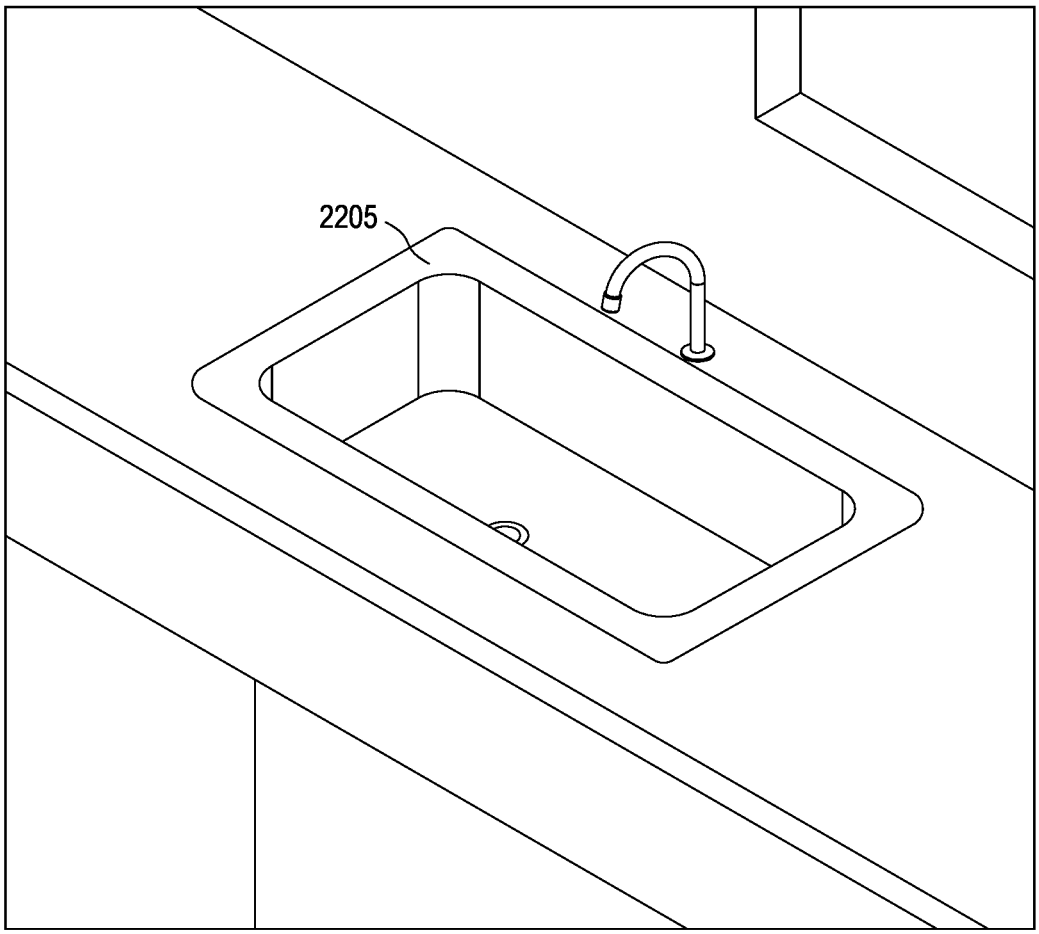

Referring to FIG. 22, FIG. 22 is a matchbox embodiment 2200 of the sink cover shown from a top perspective view. The matchbox embodiment, like the embodiment of FIG. 13, may extend in one dimension to fit the shape of a sink basin. It comprises two portions that may the positioned relative to each other in one dimension and is similar to the opening and closing of a matchbox. In the embodiment shown in FIG. 22, a first portion 2205 surrounds a second portion 2210 in a plane that is perpendicular to the longitudinal axis 2215 of movement between the two portions. The two portions may be extended or shortened along the longitudinal axis 2215 depending on the dimensions of the sink basin. Further, the two portions may be translated toward each other to shorten the sink cover when it is not use so as to take up a minimum volume.

In various embodiments, the two portions may include a means to secure the two portions to one another and prevent them from separating into two non-contacting portions. In one example, the two portions include a fastening mechanism that prevents the two portions from extending beyond a maximum length. The matchbox embodiment 2200 may be shaped to cover a sink basin with its outer perimeter resting on the countertop that surrounds the sink basin.

The extendibility of the matchbox embodiment 2200 may be especially useful for a dual use of the sink cover whereby the sink cover is extended to a first length when it covers a sink basin and the sink cover is shortened to a second length when it is inverted to hold kitchenware such as dishes and utensils.

In an additional use, the matchbox embodiment 2200 may be shortened to expose a portion of the sink basin while the matchbox embodiment 2200 is positioned to cover a sink. Thus, the matchbox embodiment 2200 may be shortened to quickly gain access to a sink basin without removing the matchbox embodiment 2200 from a sink. In various embodiments, the matchbox embodiment, may include more than 2 moveable portions. For instance, the matchbox embodiment may comprise 3 portions where a first portion surrounds a second portion in the plane that is perpendicular to the longitudinal axis 2215, and the second portion surrounds the third portion in the plane.

The matchbox embodiment 2200 may include one or more handles that are positioned perpendicular to the longitudinal axis 2215. Thus, the handles advantageously situated for a user to grip them to translate the two or more portions relative to one another along the longitudinal axis.

Figure 23:
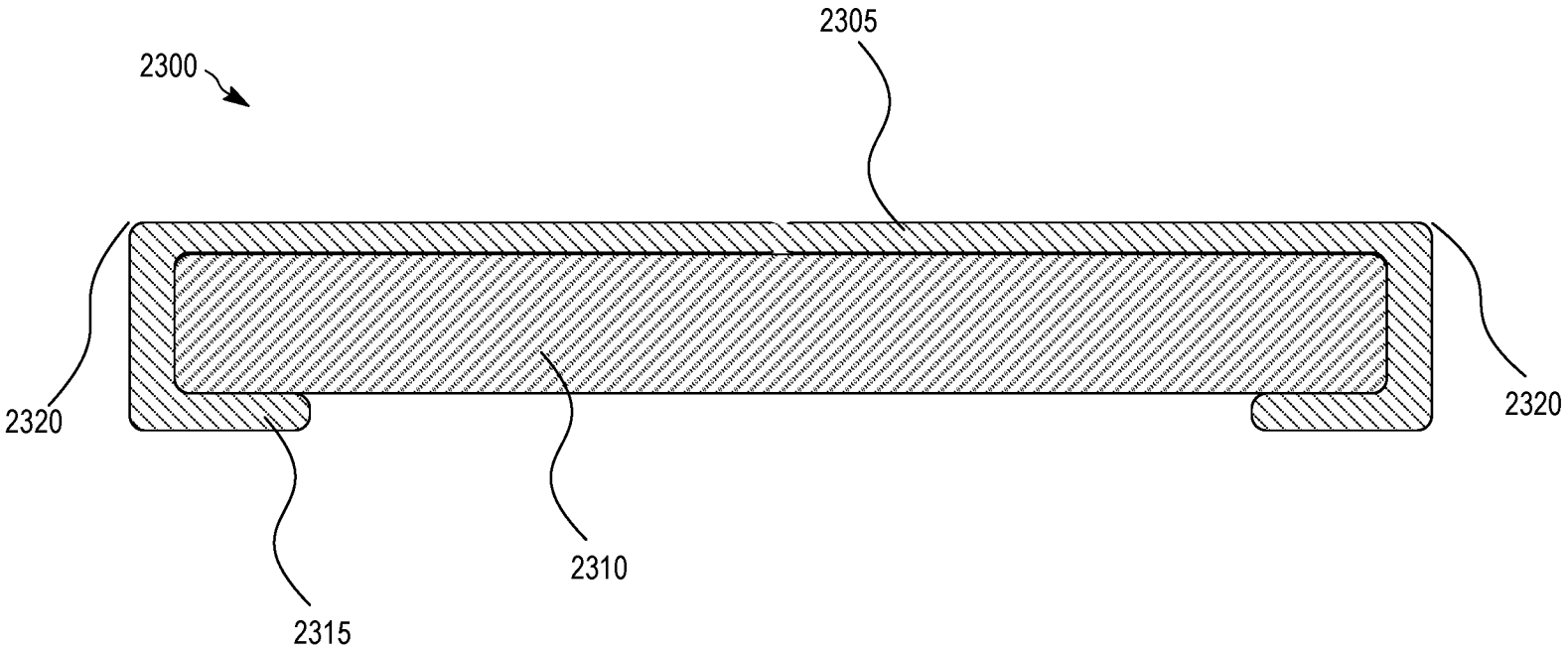
FIG. 23 is a cross sectional view of the matchbox embodiment.

Referring to FIG. 23, FIG. 23 is a cross sectional view 2300 of the matchbox embodiment. The matchbox embodiment includes two or more portions that are configured to translate relative to one another along the longitudinal axis 2215. The cross sectional view 2300 includes a first portion 2305 and a second portion 2310. The width, as measured from the left to right of the cross sectional view 2300, of the first portion is wider than the second portion 2310 such that the second portion fits within "L" shaped brackets 2315 that extend from the ends 2320 of the first portion 2305.

The brackets 2315 restrict relative translation between the first portion 2305 and second portion 2310 to the longitudinal axis 2215, which is perpendicular to the cross sectional view 2300. In various embodiments, other means of restricting relative translation between the first portion 2305 and second portion 2310 to the longitudinal axis 2215 may be used. In one example of another means, the first portion 2305 may surround the second portion 2310 in the cross sectional view.

Figure 24A:
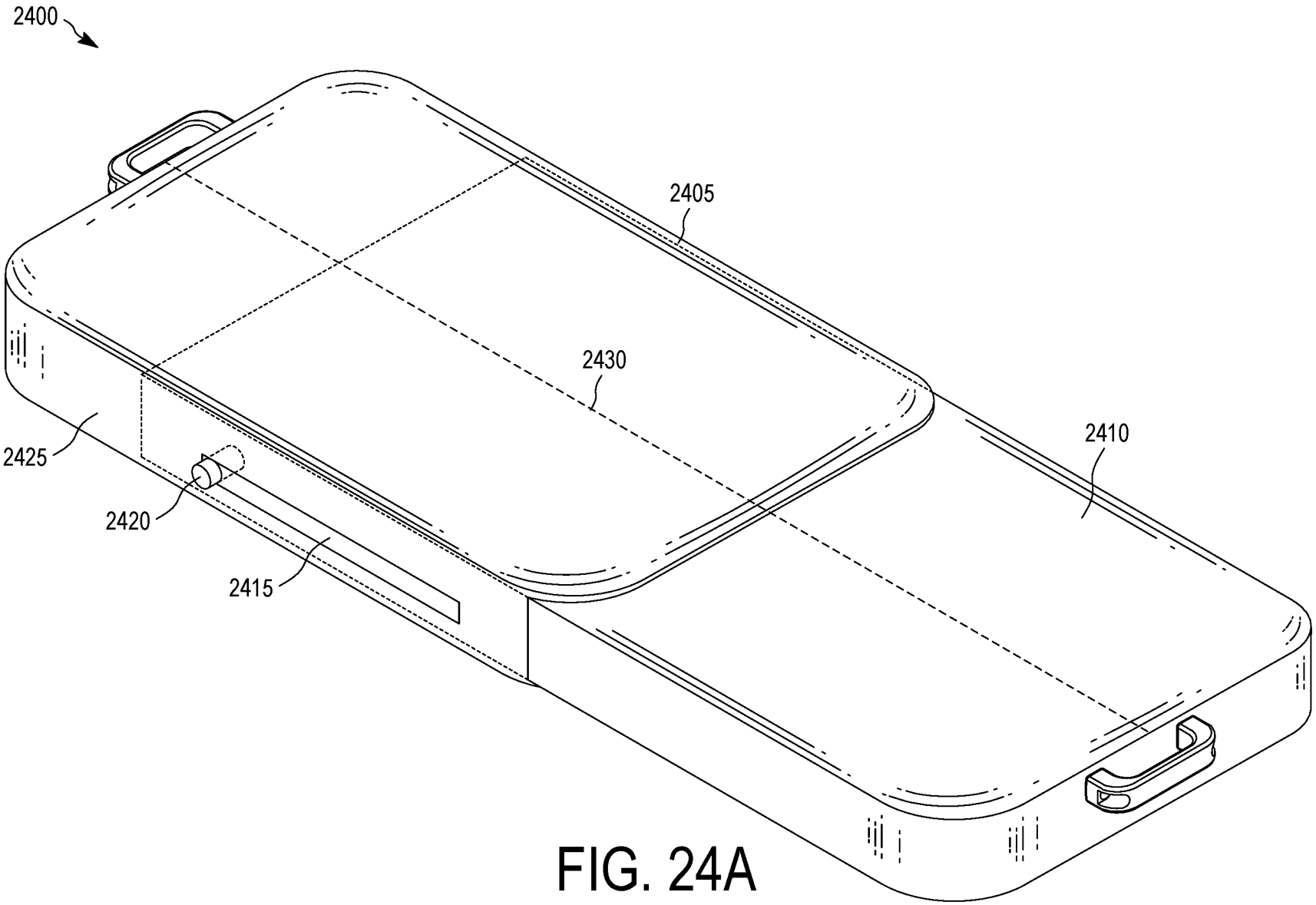
FIG. 24A is another exemplary matchbox embodiment of the sink cover from a top perspective view.
Figure 24B:
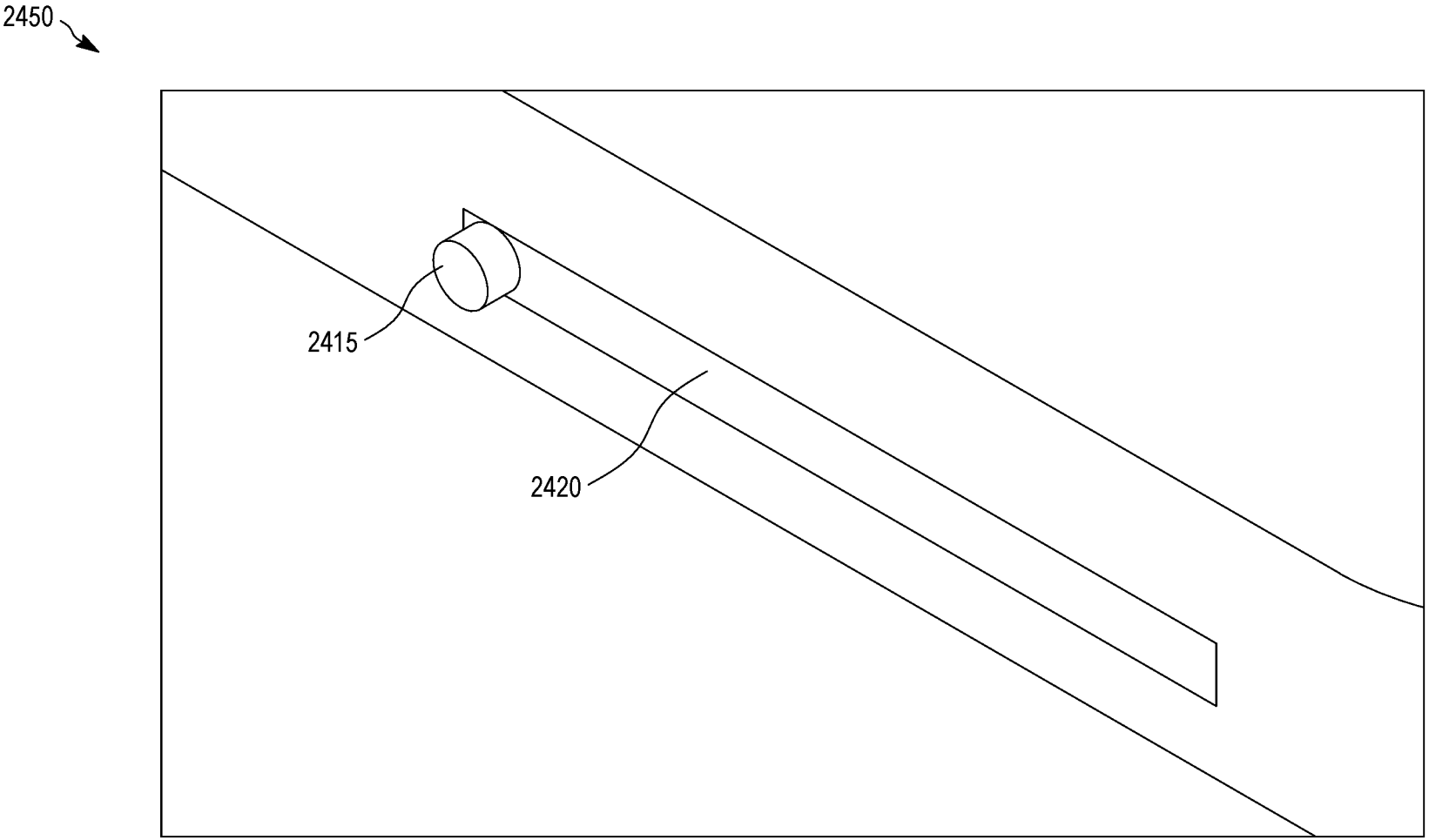
FIG. 24B is a magnified side view of the matchbox embodiment from FIG. 24A showing a slide and stopper mechanism.

Referring to FIG. 24A and FIG. 24B, FIG. 24A is a top perspective view of the matchbox embodiment of a sink cover 2400. FIG. 24B is a magnified side view 2450 of the matchbox embodiment from FIG. 24A showing a slide and stopper mechanism. The matchbox embodiment includes a first portion 2405 that includes an "L" shaped bracket that restricts relative movement between the first portion 2405 and a second portion 2410 to the longitudinal axis. In various embodiments, the shape of the sink cover 2400 shown in FIG. 24A may be sized to rest on the countertop that surrounds a sink basin.

The first portion 2405 includes a slot 2415 on each side 2425 to the left and right of the longitudinal axis 2215. The second portion 2410 includes stoppers 2420 on both sides that extend through at the respective slot. The slot and stopper restrict relative movement of the first portion and second portion to a maximum and a minimum distance on the longitudinal axis.

Figure 25:
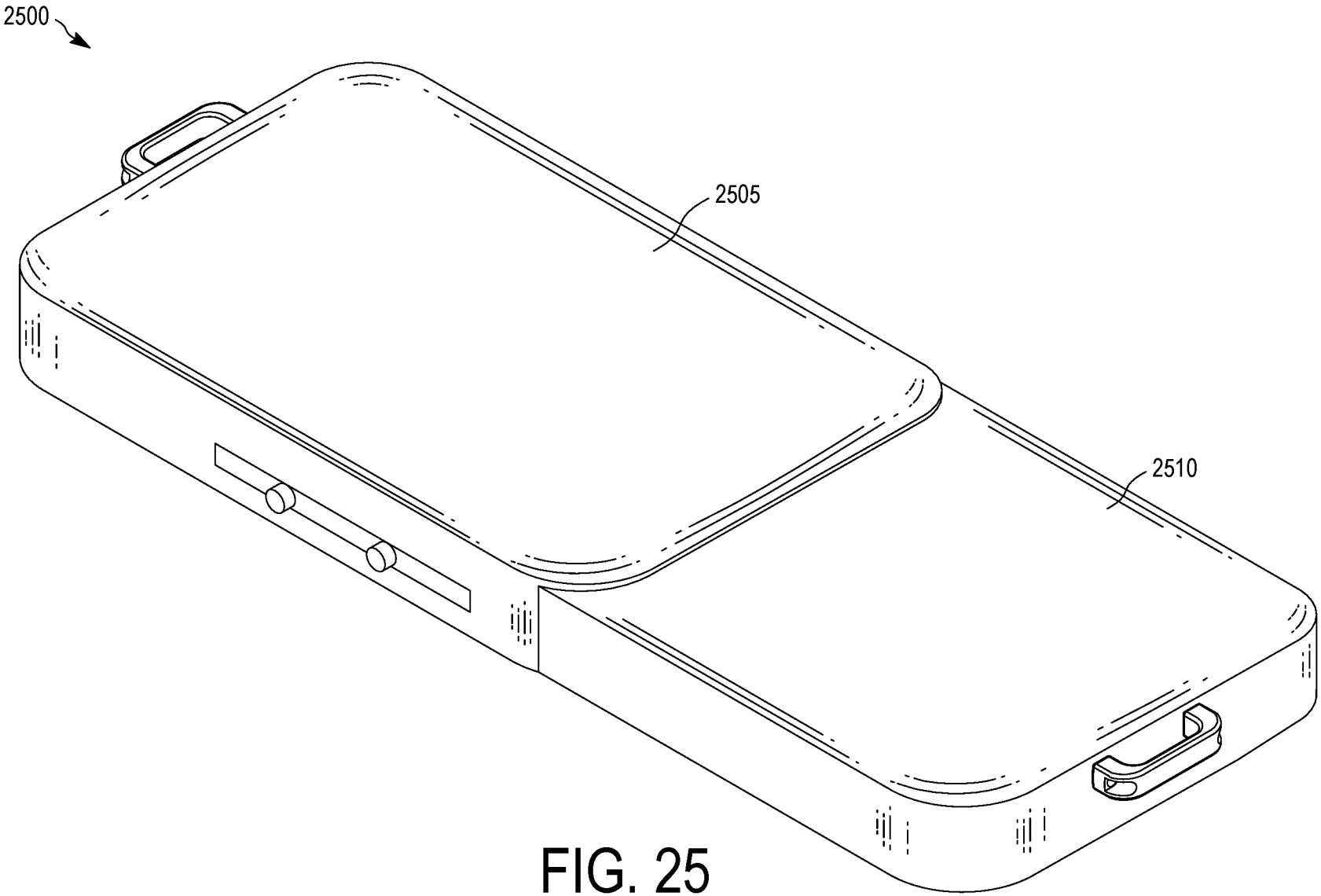
FIG. 25 is a perspective view of another matchbox embodiment of a sink cover.

Referring to FIG. 25, FIG. 25 is a perspective view of another matchbox embodiment of a sink cover 2500. The sink cover 2500 includes a first portion 2505 and a second portion 2510 that can translate relative to one another along a longitudinal axis 2215. The first portion 2505 includes a slot on both sides that is parallel to the longitudinal axis. The second portion 2510 includes at least two stoppers on both sides that extend through the respective slot on either side. The stoppers restrict relative movement of the first portion 2505 and the second portion 2510 to the longitudinal axis and also limits an amount of movement on the longitudinal axis.

Many variations may be made to the embodiments described herein. All variations, including combinations of variations, are intended to be included within the scope of this disclosure. The description of the embodiments herein can be practiced in many ways. Any terminology used herein should not be construed as restricting the features or aspects of the disclosed subject matter. The scope should instead be construed in accordance with the appended claims.

The invention claimed is:

1. A sink cover, the sink cover comprising:

a shell, comprising a first portion and a second portion that are configured to translate relative to one another in one direction, the shell configured to cover a sink basin;

wherein the shell is shaped to rest upon a surface without fasteners;

wherein a side of the first portion comprises a slot with a longitudinal portion that is parallel to the direction of translation; and wherein the second portion comprises a first stopper and a second stopper, the first stopper and the second stopper oriented to traverse the slot.

2. The sink cover of claim 1, wherein the shell comprises a plane that is shaped to make contact with a shoulder portion of the sink basin around an entire circumference of the sink basin; and wherein the shell is further shaped to fit within a perimeter of a countertop that surrounds the sink basin.

3. The sink cover of claim 2, wherein the shell is curved to increase a volume of space under the shell and within the sink basin when the shell is positioned to cover the sink basin.

4. The sink cover of claim 1, wherein the first stopper limits translation of the first portion and the second portion relative to one another in a first direction.

5. The sink cover of claim 4, wherein the second stopper limits translation of the first portion and the second portion relative to one another in a second direction that is opposite the first direction.

6. The sink cover of claim 5, wherein the shell comprises a pigment that changes color based on a temperature of the shell.

7. The sink cover of claim 5, wherein the shell comprises a heat insulating material.

8. A sink cover, the sink cover comprising, a shell, comprising a first portion and a second portion that are configured to translate relative to one another in one direction to modify a length of the sink cover, the shell configured to cover a sink basin;

wherein a side of the first portion comprises a slot with a longitudinal portion that is parallel to the direction of translation;

wherein the second portion comprises a first stopper and a second stopper, the first stopper and the second stopper oriented to traverse the slot;

wherein the first stopper limits translation of the first portion and the second portion relative to one another in a first direction;

wherein the second stopper limits translation of the first portion and the second portion relative to one another in a second direction that is opposite the first direction;

wherein the shell is shaped to make contact with a shoulder portion of the sink basin around an entire circumference of the sink basin;

wherein the shell is curved to increase a volume of space under the shell and within the sink basin when the shell is in a first position to cover the sink basin;

wherein the shell is shaped to drain water from an inside portion when the sink cover is turned 180 degrees from the first position; and wherein the shell comprises a pigment that changes color based on a temperature of the shell.

9. The sink cover of claim 8, further comprising a first handle attached to the first portion;

further comprising a second handle attached to the second portion;

wherein the first handle and the second handle are oriented to mirror one another on opposite sides of the shell; and wherein the first handle and the second handle are oriented to be pulled on a longitudinal axis of the slot.

* * * * *